US010147280B2

(12) United States Patent
Snow et al.

(10) Patent No.: US 10,147,280 B2
(45) Date of Patent: Dec. 4, 2018

(54) SYSTEMS DYNAMICALLY CHOOSING PAY TABLES, RELATED METHODS

(71) Applicant: Bally Gaming, Inc., Las Vegas, NV (US)

(72) Inventors: Roger M. Snow, Las Vegas, NV (US); Jennifer K. Farrar, Las Vegas, NV (US)

(73) Assignee: Bally Gaming, Inc., Las Vegas, NV (US)

( * ) Notice: Subject to any disclaimer, the term of this patent is extended or adjusted under 35 U.S.C. 154(b) by 271 days.

(21) Appl. No.: 15/076,292

(22) Filed: Mar. 21, 2016

(65) Prior Publication Data

US 2017/0270752 A1 Sep. 21, 2017

(51) Int. Cl.

| | |
|---|---|
| ***G07F 17/34*** | (2006.01) |
| ***G07F 17/32*** | (2006.01) |
| ***A63F 1/14*** | (2006.01) |
| ***A63F 1/18*** | (2006.01) |
| ***A63F 1/06*** | (2006.01) |
| *A63F 1/00* | (2006.01) |

(52) U.S. Cl.

CPC ..... *G07F 17/3293* (2013.01); *A63F 1/067* (2013.01); *A63F 1/14* (2013.01); *A63F 1/18* (2013.01); *G07F 17/322* (2013.01); *G07F 17/323* (2013.01); *G07F 17/3211* (2013.01); *G07F 17/3232* (2013.01); *G07F 17/3244* (2013.01); *G07F 17/3248* (2013.01); *G07F 17/3276* (2013.01); *A63F 2001/005* (2013.01)

(58) Field of Classification Search

USPC ..... 463/22

See application file for complete search history.

(56) References Cited

U.S. PATENT DOCUMENTS

| | | | |
|---|---|---|---|
| 4,861,041 | A | 8/1989 | Jones et al. |
| 5,584,486 | A | 12/1996 | Franklin |
| 6,267,248 | B1 | 7/2001 | Johnson et al. |
| 6,481,717 | B1 | 11/2002 | Richardelle |
| 6,588,750 | B1 | 7/2003 | Grauzer et al. |
| 6,698,756 | B1 | 3/2004 | Baker et al. |
| 6,755,741 | B1 | 6/2004 | Rafaeli |
| 6,845,981 | B1 | 1/2005 | Ko |

(Continued)

OTHER PUBLICATIONS

International Search Report from International Application No. PCT/US2017/021936, dated Jun. 14, 2017, 4 pages.

(Continued)

*Primary Examiner* — Pierre E Elisca

(74) *Attorney, Agent, or Firm* — TraskBritt

(57) ABSTRACT

Gaming table systems configured to at least partially automatically administer wagering games may include a gaming table with player positions having wagering areas for accepting wagers. An automatic card-handling device configured to output subsets of cards may be supported by the gaming table. An electronic display device may be positioned and oriented to be visible by at least one of a player participating in the wagering game and a dealer aiding in administration of the wagering game. A processing unit may be programmed to dynamically select a pay table corresponding to a number of eligible hands from a set of pay tables and cause the electronic display device to display the dynamically selected pay table.

29 Claims, 15 Drawing Sheets

(56) References Cited

U.S. PATENT DOCUMENTS

| | | | | |
|---|---|---|---|---|
| 6,923,446 | B2 | 8/2005 | Snow | |
| 7,367,884 | B2 * | 5/2008 | Breeding | A63F 3/00157 273/274 |
| 7,537,456 | B2 | 5/2009 | Snow | |
| 7,661,676 | B2 | 2/2010 | Smith et al. | |
| 7,677,565 | B2 | 3/2010 | Grauzer et al. | |
| 7,766,332 | B2 | 8/2010 | Grauzer et al. | |
| 7,901,285 | B2 | 3/2011 | Tran et al. | |
| 7,934,980 | B2 | 5/2011 | Blaha et al. | |
| 8,070,574 | B2 | 12/2011 | Grauzer et al. | |
| 8,262,475 | B2 | 9/2012 | Snow et al. | |
| 8,272,958 | B2 | 9/2012 | Smith et al. | |
| 8,511,684 | B2 | 8/2013 | Grauzer et al. | |
| 8,579,289 | B2 | 11/2013 | Rynda et al. | |
| 9,101,821 | B2 | 8/2015 | Snow | |
| 9,105,161 | B2 | 8/2015 | Pawloski et al. | |
| 9,162,138 | B2 | 10/2015 | Grauzer et al. | |
| 2002/0147042 | A1 | 10/2002 | Voung et al. | |
| 2002/0195773 | A1 | 12/2002 | Dunn | |
| 2004/0009799 | A1 * | 1/2004 | Breeding | A63F 3/00157 463/11 |
| 2004/0222592 | A1 * | 11/2004 | Stern | A63F 3/00157 273/292 |
| 2005/0164759 | A1 | 7/2005 | Smith et al. | |
| 2006/0205484 | A1 | 9/2006 | Nicastro | |
| 2010/0038849 | A1 | 2/2010 | Scheper et al. | |
| 2013/0184059 | A1 | 7/2013 | Costello et al. | |
| 2013/0184079 | A1 | 7/2013 | Costello et al. | |
| 2013/0296025 | A1 | 11/2013 | Castle, II et al. | |
| 2013/0324217 | A1 | 12/2013 | Gilbertson et al. | |
| 2014/0027979 | A1 | 1/2014 | Stasson et al. | |
| 2014/0038679 | A1 | 2/2014 | Snow | |
| 2014/0073417 | A1 | 3/2014 | Castle et al. | |
| 2014/0346732 | A1 | 11/2014 | Blaha et al. | |
| 2014/0370980 | A1 | 12/2014 | Czyzewski et al. | |
| 2015/0038206 | A1 | 2/2015 | Walton et al. | |
| 2015/0069704 | A1 | 3/2015 | Hemberger | |
| 2015/0080076 | A1 | 3/2015 | Snow et al. | |
| 2015/0080117 | A1 | 3/2015 | Czyzewski et al. | |
| 2017/0270752 | A1 * | 9/2017 | Snow | A63F 1/14 |

OTHER PUBLICATIONS

International Written Opinion from International Application No. PCT/US2017/021936, dated Jun. 14, 2017, 7 pages.

* cited by examiner

SYSTEMS DYNAMICALLY CHOOSING PAY TABLES, RELATED METHODS

FIELD

This disclosure relates generally to systems, apparatuses, and methods of determining and displaying information related to wagering games for casinos and other gaming establishments. More specifically, disclosed embodiments relate to systems, apparatuses, and methods of displaying award information related to a side wager where the information is dynamically related to the number of game participants.

BACKGROUND

Wagering games may be administered in pay-to-play (P2P) environments such as brick and mortar casinos and, where permitted, the Internet, as well as games in play-for-fun (P4F) environments such as entertainment-only offerings on the worldwide web or through applications downloaded to a device, such as a computer or mobile device. Conventional games include the card games blackjack, pai gow poker, Texas Hold 'Em, and the like.

When the game, such as blackjack, is hand-dealt with physical playing cards, electronic shoe devices, which are capable of reading the cards as they are dealt, generate data signals indicative of the cards used. These types of card dealing shoes are often referred to as "smart shoes." An example is disclosed in U.S. Pat. No. 9,162,138, to Grauzer et al., titled "CARD-READING SHOE WITH INVENTORY CORRECTION FEATURE AND METHODS OF CORRECTING INVENTORY," issued Oct. 20, 2015, the disclosure of which is incorporated herein in its entirety by this reference. Integrated card shufflers and delivery shoes, which can shuffle (i.e., randomize playing cards) as well as identify the rank and suit of cards in the shoe and/or as assembled into individual hands may be used, such as described in U.S. Patent App. Pub. No. 2014/0346732, to Blaha et al., filed Aug. 11, 2014, and titled "CARD HANDLING SYSTEMS, DEVICES FOR USE IN CARD HANDLING SYSTEMS AND RELATED METHODS," the disclosure of which is incorporated herein in its entirety by this reference. Accordingly, for games with physical cards, there are mechanisms to identify at least the cards in play during a game.

Hybrid game environments may use physical playing cards, but players may interface with the game through electronic terminals such as described in U.S. Patent Application Publication No. 2014/0073417, to Castle et al., now U.S. Pat. No. 8,747,220, issued Jun. 10, 2014, titled "METHODS, SYSTEMS, AND APPARATUS FOR WAGERING GAMES INCLUDING PLAYER-BANKED SIDE BETS," filed Sep. 12, 2012, the disclosure of which is incorporated herein in its entirety by this reference. Such tables may also identify at least the cards in play utilizing a smart shoe, as described previously.

Cards games may also be administered virtually using displayed representations of playing cards in a brick-and-mortar gaming environment, at an electronic table, on a gaming machine, via a standalone computer application, or by interfacing with a web-based server. In these virtual games, the applications/server likewise can track and record the cards in play at the game.

For card games, providers such as casinos continually look to provide new games, enhance older games to refresh their appeal to players, and increase their revenues generated from the games. One way to do this is to offer side bet propositions. Certain side bet propositions have been developed for blackjack as well as other games, such as pai gow poker and the like. U.S. Pat. No. 6,845,981, to Ko, issued Jan. 25, 2005, titled "CASINO GAME METHOD PROVIDING A SIDE WAGER BASED UPON A DEALER'S HAND," is an example. U.S. Pat. No. 4,861,041, to Jones et al. is another example of a side bet for a card game. As disclosed in U.S. Pat. No. 5,584,486, to Franklin, issued Dec. 17, 1996, players may make a separate jackpot side wager in the game of pai gow poker. The side wager is won if the player's seven-card pai gow poker hand is of a certain poker rank. In these games, the award schedule is independent of the number of players playing the game. The pay table is the same whether one or eight players are playing the game. For example, in the game disclosed in U.S. Pat. No. 6,481,717, to Richardelle, issued Nov. 19, 2002, a player places a blackjack wager and a poker wager. The blackjack wager is resolved according to the traditional rules of blackjack. The poker wager is resolved by providing additional cards to the player to make a player poker hand for a total of five or seven cards and then the player's poker hand is resolved against a fixed, unchanging pay table. In the game disclosed in U.S. Pat. No. 5,584,486, to Franklin, issued Dec. 17, 1996, players may make a separate jackpot side wager in the game of pai gow poker. The side wager is won if the player's seven-card pai gow hand is of a certain poker rank. The disclosure of each of the foregoing patents and patent applications is incorporated herein in its entirety by this reference.

BRIEF SUMMARY

In some embodiments, gaming table systems configured to at least partially automatically administer wagering games may include a gaming table including a playing surface having a layout displayed thereon, the layout including a plurality of player positions thereon. Each player position may include a first wagering area for accepting a first wager on a base game and a second wagering area for accepting a second wager on a secondary game. An automatic card-handling device may be supported by the gaming table, the automatic card-handling device configured to output subsets of cards from a set of randomized, physical cards comprising at least one deck of at least fifty-two standard playing cards. An electronic display device may be positioned and oriented to be visible by at least one of a player participating in the wagering game and a dealer aiding in administration of the wagering game. A processing unit may be operatively connected to at least the electronic display device and a non-transitory memory device. The processing unit may be programmed to: dynamically select a pay table corresponding to a number of eligible hands in the base wagering game from a set of pay tables stored in the nontransitory memory device, each pay table of the set of pay tables being different from each other pay table of the set of pay tables, each pay table of the set of pay tables corresponding to a single, specific number of eligible hands in a round of play of the base wagering game; cause the electronic display device to display the dynamically selected pay table; resolve the first wager by evaluating all hands available to each participating player to determine whether they satisfy a base game winning condition; resolve the second wager by evaluating all hands available to each player participating in the base game to determine whether a best hand formable from any hand available to any participating player is a predetermined winning hand; and generate an electronic signal indicating that payment of a payout on the second wager to each participating player from whom the second wager was accepted from the pay table is authorized when any best hand available to any participating player is a predetermined winning hand, an amount of the payout shown on the pay table corresponding to a highest-ranked predetermined winning hand available to any participating player.

In other embodiments, methods of administering wagering games may involve accepting a first wager on a base game from one or more participating players by receiving a first physical, monetarily valuable wagering element in a first designated area of a player position of each of the one or more participating players on a layout design on a playing surface of a gaming table. An optional second wager on a secondary game may be accepted from at least one of the one or more participating players by receiving a second physical, monetarily valuable wagering element in a second designated area of the player position of the at least one of the one or more participating players on the layout design on the playing surface of the gaming table. Cards may be dealt to the one or more participating players and to a dealer from a set of randomized, physical cards comprising at least one deck of at least fifty-two standard playing cards from an automatic card-handling device supported by the gaming table. A pay table corresponding at least partially to a number of participating players in the base wagering game may be displayed on an electronic display device, the pay table being dynamically selected from a set of pay tables, each pay table of the set of pay tables being different from each other pay table of the set of pay tables, each pay table of the set of pay tables corresponding at least partially to a single, specific number of participating players in a round of play of the base wagering game. The first wager may be resolved by evaluating all eligible hands available to each of the one or more participating players to determine whether each hand satisfies a base game winning condition. The second wager may be resolved by evaluating all hands available to each of the one or more participating players to determine whether a best hand formable from all hands available to any of the one or more participating players is a predetermined winning hand. A payout on the second wager may be paid from the pay table to each participating player in the secondary wagering game when any best hand formable from all hands available to any participating player is a predetermined winning hand by transferring at least one physical monetarily valuable wagering element to the at least one of the one or more participating players, an amount of the payout shown on the pay table.

BRIEF DESCRIPTION OF THE DRAWINGS

While this disclosure concludes with claims particularly pointing out and distinctly claiming specific embodiments, various features and advantages of embodiments within the scope of this disclosure may be more readily ascertained from the following description when read in conjunction with the accompanying drawings, in which:

DETAILED DESCRIPTION

Figure 1A:
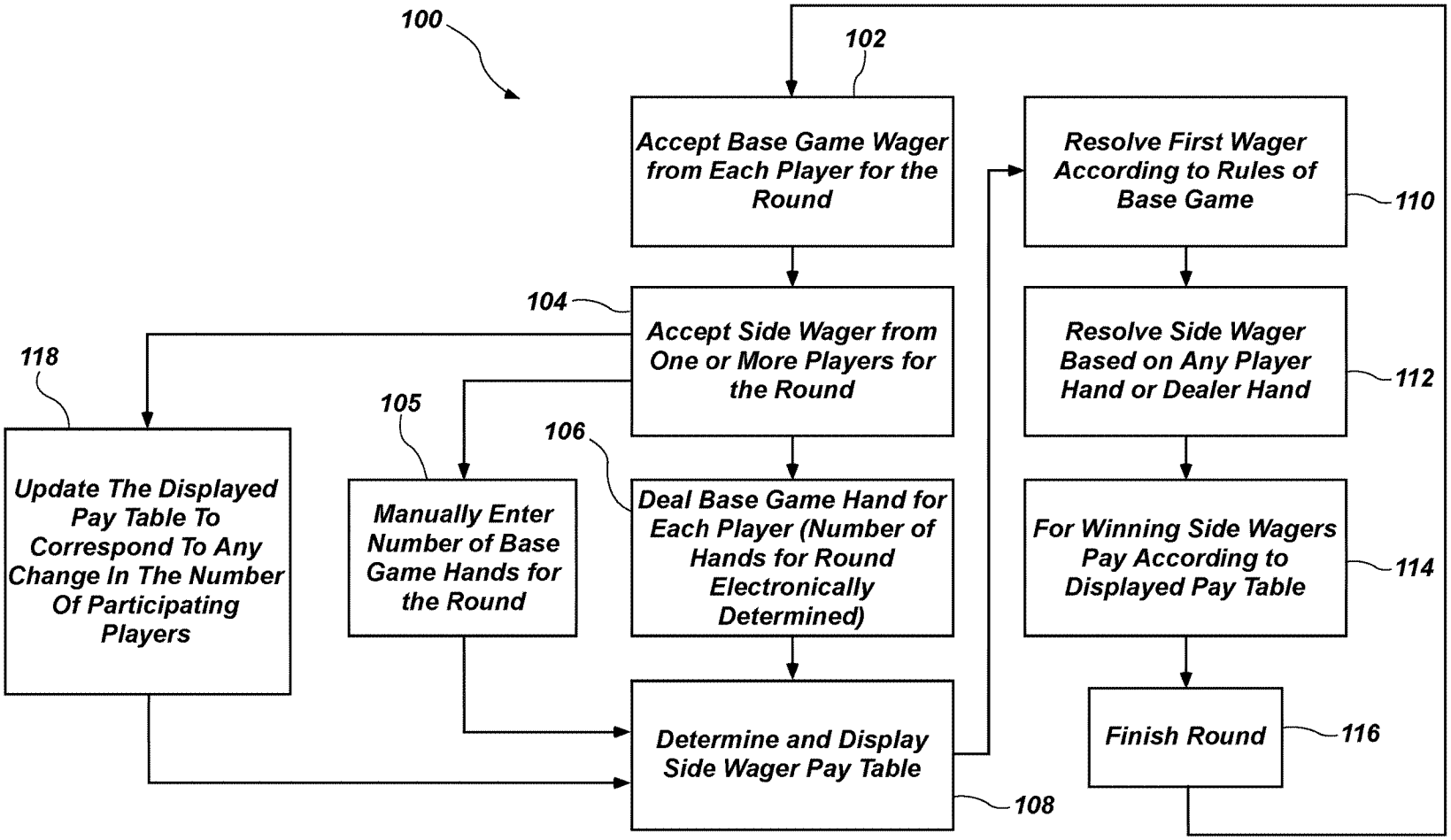
FIG. 1A is a flowchart diagram of a method of administering a wagering game utilizing a system or apparatus, according to an embodiment of this disclosure.

The illustrations presented in this disclosure are not meant to be actual views of any particular act in a method, apparatus, system, or component thereof, but are merely idealized representations employed to describe illustrative embodiments. Thus, the drawings are not necessarily to scale. Additionally, elements common between figures may retain the same or similar numerical designation. Elements with the same number, but including a different alphabet character as a suffix should be considered as multiple instantiations of substantially similar elements and may be referred generically without an alphabet character suffix.

The terms "gaming," "gambling," or the like, refer to activities, games, sessions, rounds, hands, rolls, operations, and other events related to wagering games the outcome of which is at least partially based on one or more random events ("chance" or "chances"), and on which wagers may be placed by a player. In addition, the words "wager," "bet," "bid," or the like, refer to any type of wager, bet, or gaming venture that is placed on random events, whether of monetary or non-monetary value. Points, credits, and other items of value may be purchased, earned, or otherwise issued prior to beginning the wagering game. In some embodiments, purchased points, credits, or other items of value may have an exchange rate that is not one-to-one to the currency used by the user. For example, a wager may include money, points, credits, symbols, or other items that may have some value related to a wagering game. Wagers may be placed in wagering games that involve the risk of real-world monetary value for the potential of payouts with real-world monetary value (e.g., the "play-for-pay," such as "house-banked," "player-banked," "player-pooled" including "player-pooled progressive," and "dividend refund" configurations, each of which is described in more detail below) or in wagering games that involve no real-world monetary risks for the player (e.g., the "play-for-fun" and "social play-for-fun" configurations described in more detail below).

As used herein, the term "wager" includes any form of wagering value, including money, casino chips, other physical means for payment, and online or remote electronic authorization of a wager in any acceptable form to the casino or online or virtual game host. Also included are physical representations of money (e.g., casino chips) at a local game, as well as virtual representations of money in the form of electronic authorizations of a transfer of money and digital representations of money (e.g., digital representations of bills or coins, digital representations of chips, numerical quantities of money, numerical quantities of points, or numerical quantities of credits) at a local or remote electronic gaming device. As used herein, the term "wagering element" means and includes objects and symbols used to signify the acceptance of a wager. For example, physical wagering elements include physical money (e.g., bills and coins) and physical wagering tokens (e.g., poker chips), which may or may not be redeemable for monetary value and may or may not include electronic identifiers (e.g., RFID chips) embedded within the tokens, enabling electronic sensing and tracking of wagering. Virtual wagering elements include, for example, images (e.g., images of money or poker chips) and text (e.g., a string of numbers), which may or may not be redeemable for monetary value. In the "play-for-fun" and "social play-for-fun" configurations, a "wager" may not have a cash value (i.e., a real-world monetary value). Wagers may also be presented by symbols appearing on a screen display, such as the appearance of a virtual coin, a dollar sign, a happy face, a thumbs up graphic or any other graphic that may be associated with a wager.

As used herein, the term "round," when used in the context of playing a wagering game, means and includes the period of time beginning when wagers permitting players to participate in the wagering games are first acceptable and ending after such wagers have been resolved and before such wagers are again accepted. For example, a round of play may begin with the acceptance of wagers, continue through generation of randomized outcomes (e.g., dealing and evaluating cards) and through acceptance of any player elections (e.g., raising, placing play wagers, folding), and end after resolution of at least some wagers, but before acceptance of any new wagers. A "round" of play typically ends when cards are returned to the dealer and the dealer causes the cards to be shuffled and redistributed to all participating players for the next "round" of play.

As used herein, the term "participating player" means and includes each player in a specific grouping of players from whom a participatory stake in a given wagering game is accepted. For example, "participating players" may include all the players located around a single gaming table comprising a felt game table or an electronic game table and from whom wagers are accepted, all the players in a bank of electronic gaming machines administering a shared wagering game, or a grouping of players up to a predetermined maximum connected to a shared session of a wagering game over a network (e.g., the Internet). Of course, a number of participating players may be assembled from those playing, for example, at a gaming table, in combination with players participating in the same round of the game via a network. By way of further example, players in a bank of electronic gaming machines or connected to a shared server configured to administer a wagering game over a network, but who do not share a common random outcome generation (e.g., receive cards from different sets of cards and play against separate dealer hands), may not be "participating players" with respect to one another.

For the purposes of this description, it will be understood that when an action related to accepting wagers, making payouts, dealing cards, selecting cards, or other actions associated with a player or a dealer is described herein, and such description includes a player or a dealer taking the action, the results of the action may be computer generated and may be displayed on a live or virtual table or electronic display, and, if applicable, the reception or detection of such an action in an electronic form where player and dealer choices, selections, or other actions are received at an electronic interface. This further includes the results of a virtual dealer and virtual players, where the actions described are actually generated by a computer (typically associated with an online game). By way of a further example, if dealing of a card is described herein, the description includes (but is not limited to) the following: the dealing of a card by a dealer from a deck, shuffler, shoe, or other card source and the reception or placement of the card at a table location associated with a player or reception directly by a player; the generation and transmission of an electronic indication or representation of a card from a game play source or server to an electronic receiver, where the receiver may be at a table (using virtual cards) including players and/or virtual players and/or a dealer or virtual dealer, on a gaming terminal, at a public display in a casino, at a remote location (e.g., using online or Internet game play), or at other locations. Also included is the representation of a card on a display or displays, and, if applicable to the action described, an electronic reception of an indication that the card has been received, selected, or otherwise interacted with at a location associated with a player, or, associated with a virtual player. In addition, dealing of a card may refer to revealing a representation of a card on a scratch-off card (also referred to as "scratchers").

A drawback to side wagers for existing games is that a player may only wager upon and win based upon their own hand. It would be advantageous to enable a player to place a side wager on a proposition, which can be won based upon any hand at the table giving the player multiple opportunities to win the wager. Such an approach would be exciting to players and for a table with multiple players a sense of camaraderie would be fostered because players making the wager would be cheering on other players to have proposition-fulfilling hands.

Referring to FIG. 1A, a flowchart diagram of a method 100 of administering a wagering game is shown. The method 100 may involve accepting a first wager on a base game from each player, as indicated at 102. The first wager may be, for example, a mandatory ante wager required for the player to participate in the base game. The base game may be, for example, a card-based wagering game. As specific, nonlimiting examples, the base game may be blackjack, a variant of blackjack, pai gow poker, poker, or a variant of poker (e.g., ULTIMATE TEXAS HOLD 'EM®).

Accordingly, resolution of the first wager may depend on the particular resolution mechanics for the underlying base game according to the rules for the base game. The first wager may be accepted, for example, by physically receiving money or a representation of money (e.g., a chip or token) on a designated wagering area on a layout of a gaming table, by a processor receiving a signal from a user interface indicating a wager has been received, or by receiving electronic authorization to charge a player account (e.g., a credit account or a bank account). More specifically, the first wager may be accepted, for example, by a dealer receiving one or more physical wagering elements within a designated base game area 130 (see FIG. 2) on a surface 120 (see FIG. 2) of a gaming table 200, 400, or 500 (see FIGS. 3, 5, 6), by automatically detecting (e.g., using sensors, such as, for example, optical or RFID sensors) the presence of one or more wagering elements within a designated area 130 (see FIG. 2) on a surface 120 (see FIG. 2) of a playing table 200, 400, or 500 (see FIGS. 3, 5, 6), or by receiving electronic authorization at a processor 350, 414, 428, 597, or 642 (see FIGS. 4-6, 9) to charge a player account via a player interface 332, 416, 532, 624, or 644 (see FIGS. 4-7, 9) or dealer interface 418 (see FIG. 5), where the player interface may be remotely located from the dealer or a server of which the processor 350, 414, 428, 597, or 642 (see FIGS. 4-6, 9) is a component. As a specific, nonlimiting example, a first wager may be accepted by receiving a physical, monetarily valuable wagering element 212 (see FIG. 3), such as a gaming chip, in a first designated area 130 (see FIG. 2) on a surface 120 (see FIG. 2) of a gaming table 200, 400, or 500 (see FIGS. 3, 5, 6).

A second wager may also be accepted from one or more of the participating players to participate in a secondary game, as indicated at 104. The second wager may be, for example, a side wager or bonus wager. The second wager may be optional, such that a player may be permitted to participate in the base wagering game even though the second wager is not received from the player, in some embodiments. In other embodiments, the second wager may be mandatory to grant the player permission to participate in the base game as well as the side wager proposition. The second wager may be on the achievement by at least one participating player or a dealer hand of a predetermined winning hand, as described in greater detail below. For example, the proposition associated with the second wager may be based upon any hand, even hands of players who have not made the side wager and, optionally, the hand of the dealer, during the round achieving a side wager winning outcome. Acceptance of the second wager may be accomplished, for example, by performing any of the actions described previously in connection with accepting the first wager, with an illustrative exception that a designated area 132 (see FIG. 2) separate from the area 130 designated for the first, ante wager on the surface 120 (see FIG. 2) of the gaming table 200, 400, or 500 (see FIGS. 3, 5, 6) may be used to receive one or more wagering elements for the second wager on the secondary game.

Additional wagers (e.g., side wagers and base game wagers), such as, for example, blind wagers, progressive bonus wagers, play wagers, double down, split, and proposition wagers may be offered in addition to the second wager. Such additional wagers may result in the award of fixed amounts, odds payouts, a jackpot prize, a progressive prize, a portion of a progressive prize or a prize of value, such as a car, a vacation, or another object of value, for example.

A feature related to the side wager is the development of a pay table, which is dynamic in that the pay table applicable to the side wager for a round (or hand) of play of the game depends, at least in part, on the number of players participating in the base game, and in some examples the number of hands available to the player for secondary play resolution, including, but not limited to, a dealer hand. Accordingly, after initial wagering is concluded, in some embodiments, a live, in-person dealer may manually enter the number of players participating in the base game or the number of available hands into a display-controlling apparatus, as indicated at 105. This entry may be made at a card-handling device 204A (see FIG. 3), such as a card shuffler, or a separate input apparatus, such as a dealer interface 418 (see FIG. 5). This entry issues a signal to a processor such as processor 428 (FIG. 5) indicative of the number of participating players for the base game. In an alternative embodiment, a card-handling device 204B may group and package hands for removal by the dealer to provide to the players. The card-handling device 204B may generate and send a signal to a processor 350, 414, 428, 597, or 642 (see FIGS. 4-6, 9) controlling an electronic display device 209, 210, 332, 374, 404, 416, 430, 560, 564, 532, 622, 658, and 688 (see FIGS. 3-9) indicative of the number of players participating in the base game based upon the number of hands packaged and distributed. In other embodiments, the shuffler may generate a signal indicating a number of hands available for secondary play, including all player hands and a dealer hand, if permitted by the game play steps of the secondary game. For example, the dealer may make serial entries for each player, whereupon hands are packaged (e.g., five randomly selected cards are grouped together), and each hand is distributed to a respective player. After all hands have been distributed, the dealer may make an entry signaling the end of dealing whereupon the card-handling device knows the number of hands dealt to an active base game player and issues the signal to the processor 350, 414, 428, 597, or 642 (see FIGS. 4-6, 9). As a specific, nonlimiting example, the card-handling device 204B may automatically dispense packets of cards (e.g., hands) until the dealer instructs the card-handling device 204B to stop dispensing packets of cards, responsive to which the processor 350, 414, 428, 597, or 642 (see FIGS. 4-6, 9) may automatically generate a signal indicative of the number of packets dispensed, which may correspond to the number of participating players or may require additional manipulation to deduce the number of participating players (e.g., by subtracting one from the number of packets dispensed to result in the number of participating players by discounting the dealer hand), and store the resulting number data corresponding to the number of participating players in nontransitory memory.

When the base game is a game where player hands are compared to a dealer hand, the dealer hand may, or may not, be eligible for secondary game play. In instances where the base game is not played against a dealer hand, only the player hands may be eligible for secondary game play in some embodiments. In one embodiment, the ULTIMATE TEXAS HOLD 'EM® game is the primary game that compares player hand rankings to a dealer hand ranking and the dealer hand is eligible for secondary game play. When a dealer hand is eligible, the dynamic pay tables may account for the presence of this extra hand. Regardless of whether or not the base game is played against a dealer hand, the dynamic pay tables may be related at least to the number of player hands dealt in the base game. In some embodiments, a shuffler may determine a number of available hands by either counting a number of hands dispensed, or counting a number of hands and applying that number to an algorithm to determine a number of eligible hands and a corresponding dynamic pay table. For instance, in games played against a dealer hand where the dealer hand is not eligible for secondary game play, the shuffler processor or another processor may subtract one from the number of hands dispensed to arrive at a number of available player hands.

For hybrid-, virtual-, computer-, and mobile-device-based gaming, the controlling processor may be programmed to determine the number of players participating in the base game by the first wagers electronically registered by the players. When the game format is live gaming on a gaming table, first wagers may be, for example, sensed by bet sensors, and those bet sensors may send a signal to the game processor indicating participation in the base game. The processor may then sum the total number of participating players to determine which dynamic pay table to select. For example, when the base game is played against a dealer hand that is eligible for secondary game play and four player wagers are sensed, the processor may select a dynamic pay table corresponding to five eligible hands. If the shuffler delivered a set of community cards used to complete each hand, then the algorithm would subtract the community card set from the total dispensed to arrive at a number of eligible hands and the corresponding pay table to select.

As described in further detail below, when the number of players (or number of eligible hands) participating in the base game is determined, the processor 350, 414, 428, 597, or 642 (see FIGS. 4-6, 9) may determine the side wager pay table to apply to the round of play of the game and may control one or more electronic display devices 209, 210, 332, 374, 404, 416, 430, 560, 564, 532, 622, 658, and 688 (see FIGS. 3-9) to display the applicable side wager pay table to the player(s).

After initial wagering is concluded, cards may be dealt (e.g., hand-distributed or electronically displayed) to each respective player, as indicated at 106. A total number of cards dealt to the player may be, for example, less than, equal to, or more than a total number of cards permissible in a final hand to be formed by the player. More specifically, the total number of cards dealt to the player may be, for example, two, three, four, five, six, or seven. In some embodiments, at least one card dealt to the player may be dealt face up. A number of the cards dealt face up may be, for example, the total number of cards, one fewer than the total number of cards, half the totally number of cards, or just one. In some embodiments, at least one card dealt to the player may be dealt face down. A number of the cards dealt face down may be, for example, the total number of cards dealt to the player, one fewer than the total number of cards, half the total number of cards, or just one. More specifically, the number of the cards dealt face down to the player may be, for example, one, two, three, four, five, six, or seven. As a specific, nonlimiting example, two cards may be dealt to the player, each face down (e.g., into a designated area 128 of a player position 122 (see FIG. 2)).

In some embodiments, cards may be dealt to a dealer hand for resolution of the first wager by comparison of a final player hand to a final dealer hand. Blackjack and Pai Gow are examples of such games. A total number of cards dealt to the dealer hand may be, for example, less than, equal to, or more than a total number of cards necessary or permissible in a final dealer hand to be formed. More specifically, the total number of cards dealt to the dealer hand may be, for example, two, three, four, five, six, or seven. In some embodiments, at least one card dealt to the dealer hand may be dealt face down. A number of the cards dealt face down may be, for example, the total number of cards dealt to the dealer hand. As a specific, nonlimiting example, two cards may be dealt to the dealer hand, each face down (e.g., into a designated area of a dealer position 124 (see FIG. 2)).

In some embodiments, community cards to be made available to augment each participating player hand and any dealer hand may be dealt according to the rules of the base game. A total number of community cards dealt may be, for example, equal to or more than a number of cards required to form a final hand for each of the player and the dealer hand. More specifically, the total number of community cards dealt may be, for example, two, three, four, five, six, or seven. In some embodiments, at least one card dealt to the dealer hand may be dealt face down for subsequent revealing. A number of the cards initially dealt face down may be, for example, the total number of community cards. As a specific, nonlimiting example, five community cards may be dealt, each face down (e.g., into a designated community card area 126 (see FIG. 2)).

The cards may be dealt from a set of randomized cards including, for example, at least one deck of at least fifty-two standard playing cards, as further indicated at 106. More specifically, the set of randomized cards may include, for example, one deck of fifty-two standard playing cards (i.e., two through ten, jack, queen, king, and ace in each of spades, diamonds, clubs, and hearts), multiple decks of fifty-two standard playing cards (e.g., two, four, six, or eight decks), or one or more decks of fifty-two standard playing cards and one or more additional cards (e.g., wild cards, bonus cards, jokers, cut cards, security cards, and promotional cards). The cards may be randomized, for example, by hand-shuffling a physical deck, by machine-shuffling a physical deck using a card-handling device 204B (see FIG. 3), or by randomly selecting computer-simulated cards from a computer-simulated set of cards using a processor 350, 414, 428, 597, or 642 (see FIGS. 4-6, 9). The cards may be dealt, for example, by hand-dealing physical cards (e.g., initial hands) from a physical set of cards, by hand-dealing cards removed from, and automatically packaged or grouped for removal by, a card-handling device 204B (see FIG. 3), by hand delivering groups of cards randomized and automatically presented for removal by a card-handling device 204B (see FIG. 3), or by displaying computer-simulated cards on an electronic display device 209, 210, 332, 374, 404, 416, 430, 560, 564, 532, 622, 658, and 688 (see FIGS. 3-9), from a set of cards comprising at least one deck of at least fifty-two standard playing cards.

A pay table corresponding to a number of participating players in a round, including a number of eligible hands, which may also be characterized as a session or hand, of the wagering game is displayed on an electronic display device 209, 210, 332, 374, 404, 416, 430, 560, 564, 532, 622, 658, and 688 (see FIGS. 3-9), for example, responsive to an electronic signal indicative of the number of participating players generated by a processor 350, 414, 428, 597, or 642 (see FIGS. 4-6, 9), as indicated at 108. The pay table may be, for example, selected from a set of pay tables, and each pay table of the set of pay tables may be different from each other pay table of the set of pay tables. Each pay table of the set of pay tables may correspond to a single, specific number of eligible hands in a given round of play of the wagering game. For example, in the game of ULTIMATE TEXAS HOLD 'EM® poker, when six players are participating in the base game, the shuffler may dispense eight packs of cards (i.e., six packs of player cards, a pack of dealer cards, and a pack of community cards). An algorithm for that game determines that the player and dealer packs are eligible, but the community card pack is ineligible, so the processor selects a dynamic pay table corresponding to seven eligible hands. The set of pay tables may be stored, for example, in nontransitory memory 154, 340, 595, 646 (see FIGS. 1B, 4, 6, 9) operatively connected to the electronic display device 209, 210, 332, 374, 404, 416, 430, 560, 564, 532, 622, 658, and 688 (see FIGS. 3-9), and processor 350, 414, 428, 597, or 642 (see FIGS. 4-6, 9). As another example, the pay table may be randomly generated in response to the electronic signal indicative of the number of participating players. For example, the electronic signal may initiate the process of randomly generating a pay table within a predetermined set of constraints (e.g., maximums and minimums). The set of constraints may be determined, at least in part, by the number of participating players. For example, the specific constraints placed on the random generation of the pay table may be selected from a set of constraints, each set of constraints corresponding to a single, specific number of participating players in a given round of play of the wagering game.

The dynamically selected or generated pay table is used when designating payouts on the second wager. Thus, different payouts on the second wager may be provided for the same winning conditions when different numbers of participating players are engaged in play of a round of the base wagering game. For example, greater payouts may generally be paid when fewer numbers of participating players are playing a shared session of the wagering game inasmuch as there may be fewer hands for a player having made the side wager to access to fulfill a winning proposition (e.g., there are fewer hands which may include a winning outcome). Continuing the example, smaller payouts may generally be paid on the second wager when greater numbers of participating players are playing a shared session of the wagering game because there are more hands available, which could include a winning outcome. As a specific, nonlimiting example, the set of pay tables and corresponding numbers of participating players may be as follows:

| Predetermined | Number of Players | | | | | |
|---|---|---|---|---|---|---|
| Winning Hand | 6 | 5 | 4 | 3 | 2 | 1 |
| Royal Flush | 70:1 | 80:1 | 100:1 | 125:1 | 150:1 | 200:1 |
| Straight Flush | 30:1 | 40:1 | 40:1 | 70:1 | 80:1 | 100:1 |
| Four of a Kind | 20:1 | 30:1 | 35:1 | 40:1 | 50:1 | 70:1 |
| Full House | 4:1 | 4:1 | 5:1 | 6:1 | 8:1 | 12:1 |

In the above example, the pay table may be based on the number of eligible player hands, as determined by the algorithm. So for example, with the game of ULTIMATE TEXAS HOLD 'EM® poker, a total of eight packs of cards may be dispensed. The shuffler may register that eight packets are dispensed, then may apply an algorithm specific to that game to determine that six player hands and one dealer hand are eligible for secondary game play. The above pay table may account for the fact that the dealer hand is eligible. For example, the column labeled "6" may be used when six players are participating in the base game. A total of seven hands (six player hands and the dealer hand) may be eligible for bonus play.

As another specific, nonlimiting example, the set of pay tables and corresponding numbers of eligible hands may be as follows:

| Predetermined | Number of Eligible Hands | | | | | |
|---|---|---|---|---|---|---|
| Winning Hand | 7 | 6 | 5 | 4 | 3 | 2 |
| Royal Flush | 70:1 | 80:1 | 100:1 | 125:1 | 150:1 | 200:1 |
| Straight Flush | 30:1 | 40:1 | 40:1 | 70:1 | 80:1 | 100:1 |
| Four of a Kind | 20:1 | 30:1 | 35:1 | 40:1 | 50:1 | 70:1 |
| Full House | 4:1 | 4:1 | 5:1 | 6:1 | 8:1 | 12:1 |

In the above example, the pay table may be based on the total number of eligible hands, as determined by the algorithm. So, for example, with the game of ULTIMATE TEXAS HOLD 'EM® poker, a total of eight packs of cards may be dispensed. The shuffler may register that eight packets are dispensed, then may apply an algorithm specific to that game to determine that six player hands and one dealer hand are eligible for secondary game play. The above pay table may account for the fact that the dealer hand is eligible. For example, the column labeled "7" may be used when six players are participating in the base game and the dealer is also eligible, resulting in a total number of seven eligible hands for bonus play.

In some embodiments, only the specific pay table corresponding to the number of participating players actually playing in a given round of play may be displayed, with the remaining pay tables of the set of pay tables remaining undisplayed. In other embodiments, each pay table of the set of pay tables may be displayed, and the current, operative pay table may be highlighted or otherwise distinguished from the non-operative pay tables.

Displaying the pay table may involve, for example, causing an electronic display device 209, 210, 332, 374, 404, 416, 430, 560, 564, 532, 622, 658, and 688 (see FIGS. 3-9) to update the images displayed thereon to include the pay table for the current number of participating players in the active round of a shared session of the wagering game. Updating the images may involve introducing an image of the respective pay table to a previously unoccupied area (e.g., when playing the first round of the wagering game), maintaining the current image of the pay table (e.g., when the number of players remains unchanged between rounds), or changing the image from one pay table to another pay table (e.g., in response to a change in the number of players from round to round).

An update to the pay table responsive to a different number of participating players in a new round of play than in an immediately preceding round may, for example, be initiated manually in some embodiments. For example, a dealer may manually input a number of participating players in the current round of play into a dealer interface 418 (see FIG. 5) (e.g., located on a card-handling device 204B (see FIG. 3) or supported directly by a gaming table 200, 400, or 500 (see FIGS. 3, 5, 6) operatively connected to the electronic display device 209, 210, 332, 374, 404, 416, 430, 560, 564, 532, 622, 658, and 688 (see FIGS. 3-9). In other embodiments, the update to the pay table may be, for example, initiated automatically. For example, one or more sensors may automatically detect one or more indicators of the number of participating players, may send an electronic signal to a processor 350, 414, 428, 597, or 642 (see FIGS. 4-6, 9) operatively connected to the sensor or sensors, which may then generate an electronic signal causing the electronic display device 209, 210, 332, 374, 404, 416, 430, 560, 564, 532, 622, 658, and 688 (see FIGS. 3-9) to display the pay table corresponding to the sensed number of participating players. As specific, nonlimiting examples, the sensor or sensors may include, for example, image sensors 138 (see FIG. 2) configured to detect the occupancy or vacancy of players' physical bodies in player positions 122, infrared sensors 140 (see FIG. 2) configured to detect the heat signatures of players' physical bodies, or wagering area sensors 136 (see FIG. 2) configured to detect the presence or absence of wagering elements thereon. As another example, the card-handling device 204B (see FIG. 3) may include a card-reading and hand-tracking system and be programmed to track a number of groups of initial cards dealt to respective participating players, such that the card-handling device 204B (see FIG. 3) automatically tracks the number of participating players. The card-handling device may also count the number of card groups or packets dispensed and the processor associated with the card shuffler may apply an algorithm to determine a number of eligible hands or eligible player hands, which in turn may determine the selection of the dynamic pay table. In some embodiments, the algorithm determines the number of players participating in the base game. In other embodiments, the algorithm may determine the number of eligible hands in the play of the base game. This information in turn may determine the dynamic pay table to apply to secondary game play.

As shown in FIG. 1A, the signals to the processor corresponding to the number of players participating in the base game may be done manually prior to, after or during the deal of the initial base game cards to the players in some embodiments. In an embodiment where the card-handling device provides the number of participating players or eligible hands, the dealer may be offered an opportunity to confirm or override the automatic hand count using a player input device as described above. To control the display to display the operative pay table for players, data signals may be required to be entered or generated, which correspond to the number of players who have made the first wager and are thus participating in the round of the base game in some embodiments.

In some embodiments, play of the base game proceeds according to base game rules before resolution of the first wager. For example, additional cards may be dealt (e.g., to a given player, the dealer hand, or to a community card area), face-down cards may be revealed, player elections may be accepted, any play wagers or raises may be accepted, and any folded wagers may be collected for the house. As one specific, nonlimiting example where the base game is blackjack, player elections to hit or split may be accepted, and corresponding additional player cards may be dealt, until the player stands or busts. Additional cards may be dealt to the dealer hand until house rules dictate that no more cards be dealt to the dealer hand or the dealer hand busts. As another specific, nonlimiting example where the base game is ULTIMATE TEXAS HOLD 'EM®, five community cards may be revealed in stages (e.g., three, one, and one), with the player being presented the option to place a play wager in decreasing amounts as more cards are revealed. The play wager may be accepted, or a player election to fold may be accepted, in response to which at least the first wager may be collected for the house. In some embodiments, acceptance of a player election to fold on the first wager may also result in collection of the second wager. In other embodiments, a player may remain eligible to win the second wager even when the player's election to fold on the first wager has been accepted.

The first wager may then be resolved by evaluating all the cards available to the player to determine whether they satisfy a base game winning condition, as indicated at 110. In some embodiments, resolution of the first wager may involve a comparison between a player's hand and a dealer's hand, such as in blackjack or pai gow poker. In other embodiments, resolution of the first wager may involve a comparison between a player's hand and a base game pay table. Examples of base games that utilize only pay tables may include LET IT RIDE® poker and MISSISSIPPI STUD® poker. In still other embodiments, resolution of the first wager may involve a comparison among respective players' hands, as in traditional poker room poker. As a specific, nonlimiting example where the base game is blackjack, a point value of the player's hand may be compared to a point value of the dealer hand and to a predetermined maximum point value (e.g., twenty-one). When the point value of the player's hand is greater than the point value of the dealer hand without exceeding the predetermined maximum point value, or when the point value of the player's hand is less than the predetermined maximum point value and the point value of the dealer hand exceeds the predetermined maximum point value, a payout on the first wager may be paid to the player.

Paying the payout on the base game wager may involve, for example, physically transferring wagering elements, crediting a win meter, or granting electronic authorization to transfer funds to a player account. More specifically, the payout may be paid by, for example, physically giving wagering elements to a player on a playing surface 120 (see FIG. 2) of a gaming table 200, 400, or 500 (see FIGS. 3, 5, 6), receiving electronic authorization at a processor 350, 414, 428, 597, or 642 (see FIGS. 4-6, 9) via a dealer interface 418 (see FIG. 5) to transfer funds from a house account server 632 (see FIG. 7) to a player account, or automatically generating electronic authorization at the processor 350, 414, 428, 597, or 642 (see FIGS. 4-6, 9) to transfer funds from an account server 632 (see FIG. 7) to a player account. As a specific, nonlimiting example, the payout may be paid by physically transferring wagering elements from a rack 208 or 420 (see FIGS. 3, 5) to the player.

When the base game is blackjack, the point value of the player's hand is less than the point value of the dealer hand, and the point value of the dealer hand is less than the predetermined maximum point value, or when the point value of the player's hand exceeds the predetermined maximum point value, the first wager may be collected for the house. The first wager may be collected for the house by, for example, physically retrieving one or more wagering elements associated with the first wager from the surface 120 (see FIG. 2) of the gaming table 200, 400, or 500 (see FIGS. 3, 5, 6) and transferring them to a rack 208 or 420 (see FIGS. 3, 5) of house wagering elements or generating electronic authorization (e.g., automatically or in response to a player or dealer input) at a processor 350, 414, 428, 597, or 642 (see FIGS. 4-6, 9) to transfer an amount of the first wager to a house account 632 (see FIG. 7).

When the point value of the player's hand is equal to the point value of the dealer hand without exceeding the predetermined maximum point value, the first wager may be returned to the player. Returning the first wager to the player may involve, for example, physically transferring each wagering element associated with the first wager to the player, electronically authorizing transfer of the amount of the first wager to the player by sending an electronic signal to a processor 350, 414, 428, 597, or 642 (see FIGS. 4-6, 9) via a dealer interface 418 (see FIG. 5), or automatically generating at a processor 350, 414, 428, 597, or 642 (see FIGS. 4-6, 9) electronic authorization to transfer the amount of the first wager to an account of the player. As a specific, nonlimiting example, the first wager may be returned to the player by physically transferring wagering elements from one or more designated areas 130 (see FIG. 2) on a playing surface 120 (see FIG. 2) of a gaming table 200, 400, or 500 (see FIGS. 3, 5, 6) to the player.

As another specific, nonlimiting example where the base game is ULTIMATE TEXAS HOLD 'EM®, a best five-card poker hand formable from the player's hole cards and the community cards may be compared to a best five-card poker hand formable from the dealer hand and the community cards. The player may have three opportunities to check or make a Play bet, but only one Play bet may be made in a round. The opportunities are after the player views his two hole cards and the first three community cards are revealed, after the fourth community card is revealed, and then after the last community card is revealed. Only one play wager area may be provided on the layout in each player area, because only one Play wager may be received in a round of play. When the player's best hand outranks the best dealer hand, a payout on the first wager, and subsequent Play wager made by accepting the wager on a designated "play" wager area on the layout, may be paid to the player, as discussed previously. When the player's best hand is outranked by the best dealer hand, the first wager and Play wager may be collected for the house, as discussed previously. When the player's best hand is of equal rank to the best dealer hand, the first wager may be returned to the player, as discussed previously. If the player elects to fold after all five community cards are revealed, the dealer may collect the first wager.

In some embodiments, the second wager may be resolved by evaluating all cards available to each player and the dealer hand to determine whether a best hand formable from all cards available to any player or the dealer hand is a predetermined winning hand, as indicated at 112. In other embodiments, the second wager may be resolved by evaluating all cards available to each player to determine whether a best hand formable from all cards available to any player (e.g., any player hand) is a predetermined winning hand, such that the dealer's hand is not included in resolution of the second wager (e.g., is disregarded). Thus, the player from whom the second wager was accepted need not have achieved the predetermined winning hand using his or her own cards to win the second wager. Rather, the player may win the second wager when any other player, the dealer hand in some embodiments, or any combination of these has achieved a predetermined winning hand. In addition, the player may win the second wager when his or her own hand constitutes a predetermined winning hand. In some embodiments where the second wager is optional, a player from whom the second wager was accepted may be entitled to a payout even when a second wager was not accepted from the player who achieved a predetermined second wager winning hand. In other embodiments where the second wager is optional, a player from whom the second wager was accepted may only be entitled to a payout when a second wager was accepted from the player who achieved a predetermined second wager winning hand or when the dealer achieves a predetermined second wager winning hand in some such embodiments. When only hands from secondary game participants qualify, the dynamic pay tables selected may correspond to the number of eligible secondary game hands, and not the number of eligible base game hands. Each player from whom the second wager was accepted may be entitled to a payout when any one participating player or the dealer hand achieves a predetermined winning hand.

For example, a best two-card, three-card, four-card, five-card, six-card, or seven-card hand formable from all available hands, according to rules applicable to the second wager may be compared to the pay table when resolving the secondary wagers. The rules applicable to the second wager, and from which predetermined winning hands may be drawn, may include, for example, pay tables constructed from blackjack point totals or poker rankings and corresponding payout odds. For example, predetermined winning hands may include nineteen or higher, twenty or higher, or specific card combinations when the rules applicable to the second wager are blackjack rules, and predetermined winning hands may include straight or higher, flush or higher, full house or higher, or four of a kind or higher when the rules applicable to the second wager are poker rules. Blackjack hands may have increasing payout odds as, for example, the point totals approach 21, and may have lesser odds for weaker hands, such as a point total of 14, for example.

In embodiments where the base game is blackjack and five-card poker rankings are used to determine whether the player's hand is a predetermined second wager winning hand, additional cards may be made available to the player and the dealer hand (e.g., in the form of cards dealt and available only to the respective player or dealer hand or in the form of community cards available to each participating player and the dealer hand) to enable the player and dealer hand to meet the minimum number of cards necessary to form a second wager qualifying hand, such as, for example, five cards. In some embodiments, additional cards such as one or two additional cards are made available to each player to make a best five-card poker hand. In ascending order, five-card poker rankings may include, for example, high card (e.g., with rankings increasing from two to ten, jack, queen, king, to ace), pair, two pair, three of a kind, straight, flush, full house, four of a kind, straight flush, and royal flush. The pay table may define which hand ranks constitute predetermined winning hands, and may display payout amounts for achieving specific hand ranks.

The best hand formable from the total number of hands available to any player, and the dealer in some embodiments, may be compared to the applicable and then-prevailing pay table by, for example, visually inspecting each hand, electronically inspecting and evaluating each hand (e.g., using sensors, such as, for example, optical or RFID sensors and a processor 350, 414, 428, 597, or 642 (see FIGS. 4-6, 9)), or electronically evaluating a computer-simulated hand at a processor 350, 414, 428, 597, or 642 (see FIGS. 4-6, 9) to determine whether it constitutes a predetermined side wager winning hand. As a specific, nonlimiting example, the cards available to the player (and optionally the cards available to the dealer) may be visually inspected by the dealer to determine the highest-ranked hand formable by the cards, and the highest-ranked hand may be compared to the pay table corresponding to the number of players participating in the current round of a shared session of the wagering game as displayed on the electronic display device 209, 210, 332, 374, 404, 416, 430, 560, 564, 532, 622, 658, and 688 (see FIGS. 3-9). As another specific, nonlimiting example, the hand available to the player (and optionally the hand available to the dealer) may be automatically read and stored by the card-handling device 204 (see FIGS. 2, 3) (e.g., using card-reading, hand forming, and card- and hand-tracking capabilities thereof) to determine the highest-ranked hand formable by the cards, the highest-ranked hand may be compared to the pay table corresponding to the number of players participating in the current round of a shared session of the wagering game as displayed on the electronic display device 209, 210, 332, 374, 404, 416, 430, 560, 564, 532, 622, 658, and 688 (see FIGS. 3-9) utilizing the processor 350, 414, 428, 597, or 642 (see FIGS. 4-6, 9), and the resulting win or loss condition may be displayed on the electronic display device 209, 210, 332, 374, 404, 416, 430, 560, 564, 532, 622, 658, and 688 (see FIGS. 3-9) (e.g., by displaying a message in text, displaying an image, or highlighting an area of the display, such as, for example, changing the color of the box corresponding to the payout in the pay table or the color of the text therein).

When the best hand formable from the cards available to any player or the dealer hand is a predetermined second wager winning hand, a payout on the second wager may be paid to the player, as indicated at 114. For example, a payout of an increasing amount may be paid on the play wager for achieving increasingly unlikely hands. In some embodiments where more than one participating player and/or the dealer hand have achieved predetermined winning hands, only a single payout corresponding to the highest ranked predetermined winning hand of all predetermined winning hands achieved may be paid to each player from whom the second wager was accepted at odds based upon their second wagers. In an embodiment where the second wagers are fixed (e.g., one unit) each player may be paid at the established odds. In another embodiment, the side wagering players would be paid at a pro rata basis based upon the odds. For example, if the award is 30:1, all players would be paid thirty units whereas in the alternative embodiment thirty units would be divided among the second wager winning players. In other embodiments where more than one participating player and/or the dealer hand have achieved predetermined winning hands, a payout corresponding to each predetermined winning hand achieved may be paid to the player. In some embodiments, the processor may control the video display to display the individual awards available to each player from whom the second wager was accepted. In some embodiments, the system, method, and apparatus may be configured to permit players to wager different second wager amounts (between a required minimum and a maximum) whereupon each player is awarded based upon the winning hand outcome and displayed odds for the winning outcome. Specific, nonlimiting amounts for the payouts are reflected in the table shown in connection with the discussion of pay table display. Payment of the payout on the second wager may be accomplished by performing any of the actions described previously in connection with payment of the payout on the first wager.

When none of the best hands formable from the cards available to each participating player and the dealer hand is a predetermined winning hand, each second wager is lost and is collected for the house. Collection of the second wager may be accomplished by performing any of the actions described previously in connection with collection of the first wager, with corresponding changes made so they apply to the second wager.

In some embodiments, the shuffler may be equipped with a card recognition system, and the composition of the packet of cards is automatically determined and stored. The stored hand compositions may be compared to the dealer hand, a pay table, or both to automatically determine the outcome of the base game. The shuffler may also utilize an algorithm to determine how many hands are eligible for secondary game play, and the shuffler may display the appropriate pay table on the associated shuffler display viewable by players. The shuffler may determine the highest ranking hand that qualifies for secondary game payouts, and may display the winning amount on the display. All players with an active secondary or bonus wager may win the displayed amount. In embodiments where secondary wagers are automatically sensed, the game processor or the shuffler processor may determine which players receive the bonus payout.

After the side wagers have been paid, if any are due, the cards and any remaining lost wagers are collected and at 116 the round is finished.

In at least some instances, the number of participating players may change after a round of play has been completed, as indicated at 118. The displayed pay table may be updated, for example, between each round of play to ensure that the displayed pay table corresponds to the correct number of participating players. For example, the pay table may be updated to remain the same or to display a different pay table, depending on whether the number of eligible hands changed when the number of participating players has changed. As another example, the displayed pay table may only be updated when the number of participating players changes from round of play to round of play.

Figure 1B:
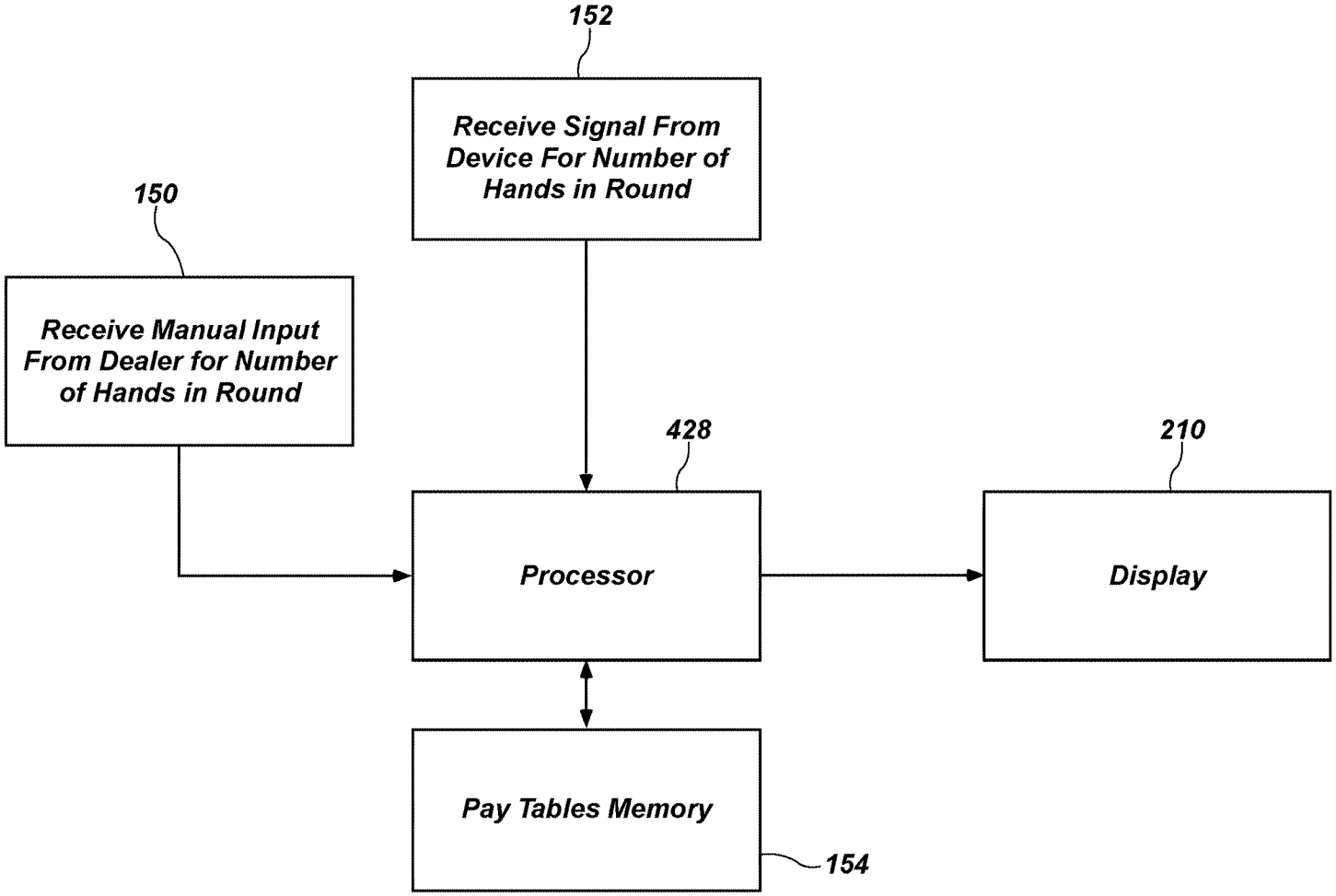
FIG. 1B is a schematic block diagram showing operative components of a system for dynamically determining which pay table from a set of pay tables for a side wager to display.

FIG. 1B illustrates an embodiment of the operative components of an illustrative system for administering such a wagering game. At 428 is a processor for dynamically determining the second wager pay table and for controlling a video display such as display 210 (see also FIG. 3). At 150, data signals from a dealer manual input device (e.g., on a shuffler) as described above are sent to the processor 428 indicative of the number of players participating in the base game. At 152, also as described above, data signals representing the number of eligible hands in play for the round may be automatically generated and sent to the processor 428. The number of eligible hands may be equal to the number of players, or it may include the dealer hand in some embodiments. The processor 428 may be configured to access a memory 154 to find the applicable pay table and to control the video display 210 to display the same to the players based upon the data signals corresponding to the number of players in the round. The video display may be integrated into the shuffler in some embodiments.

In another embodiment, the processor 428 may be configured to receive the data signals and to derive the applicable pay table from the signals and control the video display 210 to display the same to the players. It should be noted that the pay table for the second wager is dynamic since as more or fewer players play the next round, the second wager pay table changes.

Various platforms are contemplated that are suitable for implementation of embodiments of wagering games according to this disclosure. For example, embodiments of wagering games may be implemented as live table games with an in-person dealer, electronic gaming machines, partially or fully automated table games, and partially or fully automated, network-administered games (e.g., Internet games) wherein game results may be produced utilizing a processor or a live video feed of a dealer administering a game from a remote studio.

As previously noted, any of the present methods and games may be played as a live casino table card game, as a hybrid casino table card game (with virtual cards or virtual chips), on a multi-player electronic platform (as disclosed in U.S. patent application Ser. No. 10/764,827, filed Jan. 26, 2004, published as U.S. Patent Application Publication No. 2005/0164759 on Jul. 28, 2005, now abandoned; U.S. patent application Ser. No. 10/764,994, filed Jan. 26, 2004, now U.S. Pat. No. 7,661,676, issued Feb. 16, 2010; and U.S. patent application Ser. No. 10/764,995, filed Jan. 26, 2004, now U.S. Pat. No. 8,272,958, issued Sep. 25, 2012; the disclosure of each of which applications and patents is incorporated herein in its entirety by this reference), on a personal computer for practice, on a hand-held game for practice, on a legally authorized site on the Internet, or on a play-for-fun site on the Internet.

For example, in one embodiment, the players may be remotely located from a live dealer, and a live dealer and a game table may be displayed to players on their monitors via a video feed. The players' video feeds may be transmitted to the dealer and may also be shared among the players at the table. In a sample embodiment, a central station may include a plurality of betting-type game devices and an electronic camera for each game device. A plurality of player stations, remotely located with respect to the central station, may each include a monitor, for displaying a selected game device at the central station, and input means, for selecting a game device and for placing a bet by a player at the player's station relating to an action involving an element of chance to occur at the selected game device. Further details on gambling systems and methods for remotely located players are disclosed in U.S. Pat. No. 6,755,741 B1, issued Jun. 29, 2004, titled "GAMBLING GAME SYSTEM AND METHOD FOR REMOTELY-LOCATED PLAYERS," the disclosure of which is incorporated herein in its entirety by this reference.

Figure 2:
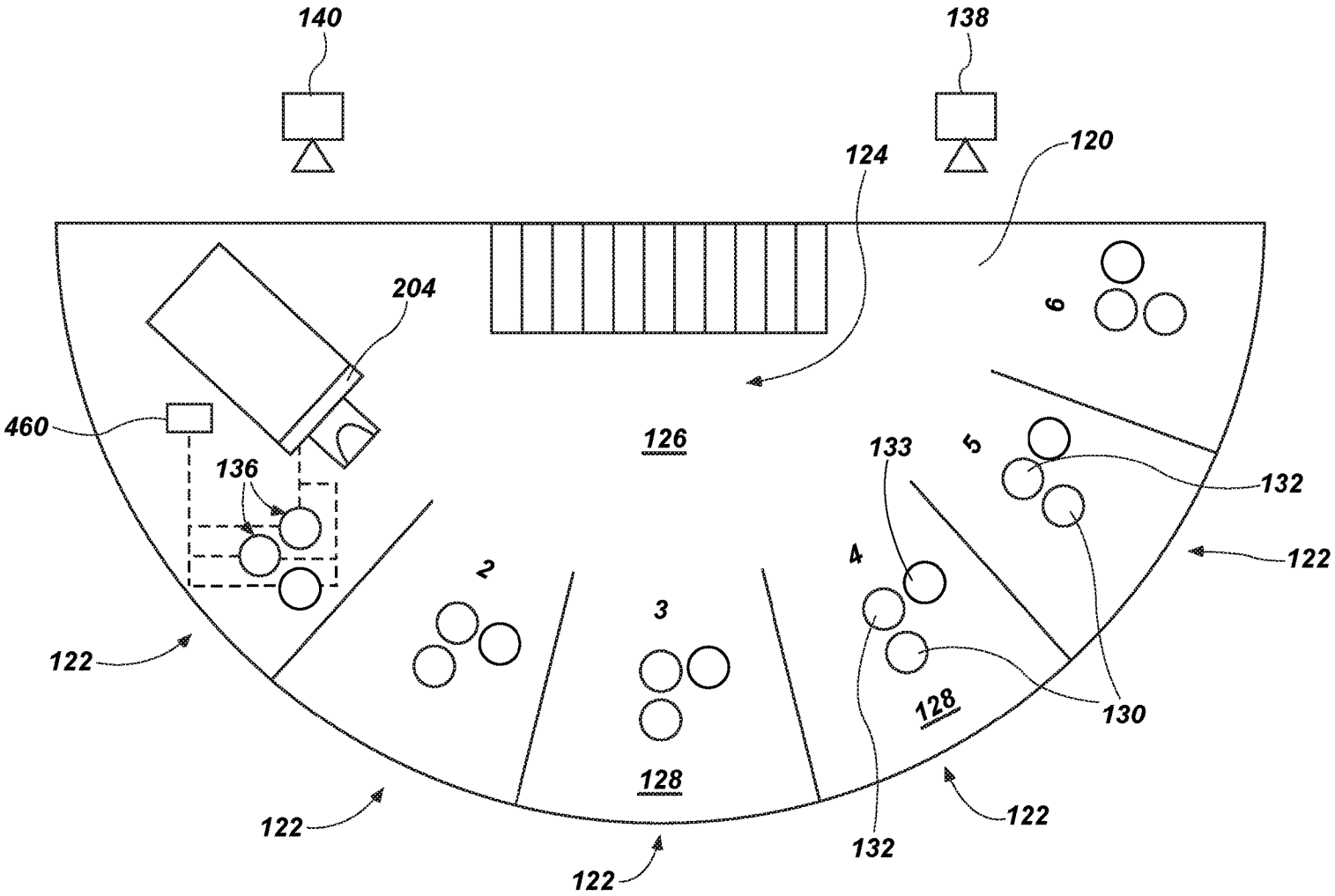
FIG. 2 is a diagram of a playing surface for implementation of a method of administering a wagering game, according to an embodiment of this disclosure.

FIG. 2 is a diagram of a playing surface 120 for implementing wagering games within the scope of this disclosure. Such an implementation may be, for example, a felt layout on a physical gaming table 200 or 400 (see FIGS. 3, 5) or an electronic representation on a display device 374, 416, 430, 532, 564, 560, 658, or 688 (see FIGS. 4-6, 8, 9) for each participating player position 122. The playing surface 120 may include player positions 122 with which individual players may interact, a dealer position 124 with which the dealer may interact, and an optional community position 126 with which the dealer may interact and within each of which the activity (e.g., wagering and card dealing) may take place. The dealer position 124 may be, for example, an area 124 from which physical cards may be dealt to the player positions 122, to which physical cards for the dealer hand may be dealt, from which payouts may be paid, and to which losing wagers may be collected. The community position 126 may be, for example, an area 126 to which physical community cards, if any, may be dealt.

Each player position 122 may include a first designated area 130 designated for accepting the first wager to play the base game. Each player position 122 may further include a second designated area 132 configured for accepting the second wager. Each player position 122 may further include a third designated area 133 configured for accepting another wager, such as, for example, a play wager to remain in the base game. Each of the first, second, and third designated areas 130, 132, and 133 may be separate and distinct from one another.

The results of actions performed when administering wagering games in accordance with this disclosure may be reflected on the playing surface 120. For example, and with continued reference to FIG. 2, a first wager on a base game played against a dealer hand may be accepted from a player, which may be reflected by the presence of one or more physical wagering elements, such as gaming chips, or the display of one or more computer-simulated wagering elements in the first designated area 130. A second wager, which may be optional or mandatory, may be accepted from the player, which may be reflected by the presence of one or more physical wagering elements or the display of one or more computer-simulated wagering elements in the second designated area 132.

Cards may be dealt to each participating player and a dealer hand from one or more randomized, fifty-two card decks of standard playing cards, which may be reflected by the presence of physical cards or the display of computer-simulated virtual cards at participating player position 122 and in the dealer area 124. In some embodiments, community cards may also be dealt, which may be reflected by the presence of cards or the display of computer-simulated cards in the community area 126. Players may be permitted to inspect their cards. In some embodiments, a play wager on the base game may be accepted from the player, which may be reflected by the presence of one or more physical wagering elements, or the display of one or more computer-simulated wagering elements in the third designated area 133 after the cards have been dealt.

A pay table from a set of pay tables corresponding to the specific number of participating players or eligible hands in the current round of the shared session of the wagering game is displayed. One system that may be used to display the pay table for a round of play may comprise a hand-forming shuffler including card-reading capability. For example, the shuffler disclosed in U.S. Pat. No. 7,766,332, assigned to Bally Gaming, Inc., the disclosure of which is incorporated herein in its entirety by this reference, may include an electronic display device 209 (see FIG. 3) on the shuffler for displaying the second wager pay table and, optionally, other game-related instructions or data. As another illustrative system for displaying the second wager pay table, a display 210 (see FIG. 3) associated with the gaming table (e.g., on a side of the gaming table opposite a side on which the participating players are located) may display the pay table corresponding to the number of participating players thereon. As yet another illustrative system for displaying the pay table, one or more electronic display devices 374, 332, 416, 532, or 564 (see FIGS. 4-6) embedded within one or more surfaces of the gaming device (e.g., the gaming table or cabinet) may display the pay table corresponding to the number of participating players thereon. For example, a processor-controlled game display, such as the display disclosed in U.S. Pat. No. 9,101,821, the disclosure of which is incorporated herein in its entirety by this reference, may be mounted into the gaming table. The display may communicate with the processor of the shuffler to display the appropriate pay table, as soon as a new round of play begins. A round activation button at the dealer station may alternatively be used to initiate update of the pay table.

The base game may proceed according to base game rules, and the first wager and any play wager may be resolved by evaluating the cards available to the player to determine whether they satisfy a base game winning condition.

In some embodiments, the second wager is resolved by comparing the best hand formable from the cards available to each respective player hand and, in some embodiments, the dealer hand to the second wager pay table. An odds payout on the second wager may be paid to each and every player from whom the second wager was accepted when the best poker hand formable from the available cards of any player, and in some embodiments the dealer hand, is a predetermined winning hand, which may be reflected by the presence of one or more additional, physical wagering elements in the player position 122 or the electronic transfer of funds to a player account. The second wager may be collected for the house when the best hand formable from the available cards of each participating player and the dealer hand is not a predetermined winning hand, which may be reflected by the physical removal of wagering elements from or cessation of displaying wagering elements within the second designated area 132 of a player's respective player position 122.

After completion of one round of the wagering game, and upon initiation of a new round of the wagering game, the pay table displayed may be updated to reflect any changes in the number of participating players.

In some embodiments, the wagering games described herein may be played against a game administrator (i.e., against "the house" such that the game is "house-banked"). Such implementations may involve the game administrator (e.g., a casino or other gaming establishment) accepting (e.g., via a dealer or other agent of the administrator) wagers of real-world monetary value, distributing payouts of real-world monetary value on winning wagers to players, and collecting real-world monetary value of lost wagers. Such "house-banked" embodiments may be implemented, for example, in the form of a live table game, in a virtual table game, in an electronic game, or in a networked (e.g., Internet) game configuration.

In other embodiments, the wagering games, or at least one wager associated with the wagering games, may involve a player in a casino or other gaming establishment acting as banker, accepting wagers having real-world monetary value, issuing payouts having real-world monetary value, and collecting real-world monetary value of lost wagers (i.e., be "player-banked"). In some embodiments where at least one wager is player-banked, the game administrator may collect a player entrance fee, or a rake on each player-banked wager accepted from the participating players, including the banker.

Figure 3:
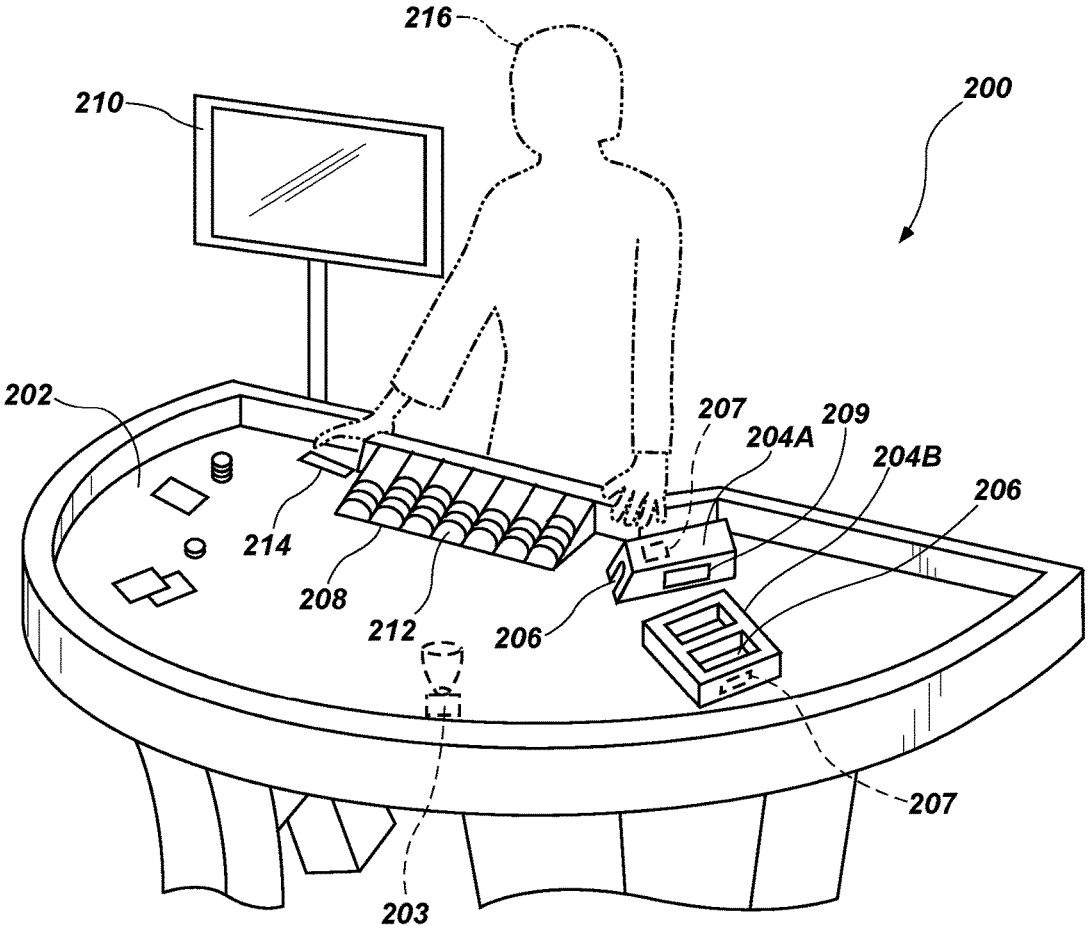
FIG. 3 is a perspective view of a gaming table configured for implementation of embodiments of wagering games in accordance with this disclosure.

FIG. 3 is a perspective view of an embodiment of a gaming table 200 for implementing wagering games in accordance with this disclosure. The gaming table 200 may be a physical article of furniture around which participants in the wagering game may stand or sit and on which the physical objects used for administering and otherwise participating in the wagering game may be supported, positioned, moved, transferred, and otherwise manipulated. For example, the gaming table 200 may include a gaming surface 202 on which the physical objects used in administering the wagering game may be located. The gaming surface 202 may be, for example, a felt fabric covering a hard surface of the table, and a design, conventionally referred to as a "layout," specific to the game being administered may be physically printed on the gaming surface 202. As another example, the gaming surface 202 may be a surface of a transparent or translucent material (e.g., glass or plexiglass) onto which a projector 203, which may be located, for example, above or below the gaming surface 202, may illuminate a layout specific to the wagering game being administered. In such an example, the specific layout projected onto the gaming surface 202 may be changeable, enabling the gaming table 200 to be used to administer different variations of wagering games within the scope of this disclosure or other wagering games. Additional details of illustrative gaming surfaces and projectors are disclosed in U.S. patent application Ser. No. 13/919,849, filed Jun. 17, 2013, and titled "ELECTRONIC GAMING DISPLAYS, GAMING TABLES INCLUDING ELECTRONIC GAMING DISPLAYS AND RELATED ASSEMBLIES, SYSTEMS AND METHODS," the disclosure of which is incorporated herein in its entirety by this reference. In either example, the gaming surface 202 may include, for example, designated areas for player positions; areas in which one or more of player cards, dealer cards, or community cards may be dealt; areas in which wagers may be accepted; areas in which wagers may be grouped into pots; and areas in which rules, pay tables, and other instructions related to the wagering game may be displayed. As a specific, nonlimiting example, the gaming surface 202 may be configured as shown in FIG. 2.

In some embodiments, the gaming table 200 may include the display 210 separate from the gaming surface 202. The display 210 may be configured to face players, prospective players, and spectators and may display, for example, rules, pay tables, real-time game status, such as wagers accepted and cards dealt, historical game information, such as amounts won, amounts wagered, percentage of hands won, and notable hands achieved, and other instructions and information related to the wagering game. The display 210 may be a physically fixed display, such as a poster, in some embodiments. In other embodiments, the display 210 may change automatically in response to a stimulus (e.g., may be an electronic video monitor).

The gaming table 200 may include particular machines and apparatuses configured to facilitate the administration of the wagering game. For example, the gaming table 200 may include one or more card-handling devices 204. The card-handling device 204A may be, for example, a shoe from which physical cards 206 from one or more decks of playing cards may be withdrawn, one at a time. Such a card-handling device 204A may include, for example, a housing in which cards 206 are located, an opening from which cards 206 are removed, and a card-presenting mechanism (e.g., a moving weight on a ramp configured to push a stack of cards down the ramp) configured to continually present new cards 206 for withdrawal from the shoe. Additional details of an illustrative card-handling device 204A configured as a shoe are found in U.S. Patent App. Pub. No. 2010/0038849, published Feb. 18, 2010, now U.S. Pat. No. 9,539,495, issued Jan. 10, 2017, and titled "INTELLIGENT AUTOMATIC SHOE AND CARTRIDGE," the disclosure of which is incorporated herein in its entirety by this reference.

The card-handling device 204B may be, for example, a shuffler configured to reorder physical cards 206 from one or more decks of playing cards and present randomized cards 206 for use in the wagering game. Such a card-handling device 204B may include, for example, a housing, a shuffling mechanism configured to shuffle cards, and card inputs and outputs (e.g., trays). Additional details of an illustrative card-handling device 204B configured as a shuffler are found in U.S. Pat. No. 8,070,574, issued Dec. 6, 2011, to Grauzer et al., the disclosure of which is incorporated herein in its entirety by this reference. Shufflers such as the devices disclosed in the '574 Patent may include card recognition capability and may form randomly ordered hands of a known composition within the shuffler. Additionally, game rules may also be programmed within the shuffler such that the processor of the shuffler is capable of identifying a winning hand prior to automatic delivery into an output tray. The card-handling device 204 may also be, for example, a combination shuffler and shoe in which the output for the shuffler is a shoe.

In some embodiments, the card-handling device 204 may be configured and programmed to administer at least a portion of a wagering game being played utilizing the card-handling device 204. For example, the card-handling device 204 may be programmed and configured to randomize a set of cards and present one or more cards for use according to game rules. More specifically, the card-handling device 204 may be programmed and configured to, for example, randomize a set of cards including one or more fifty-two-card decks of standard playing cards and, optionally, any specialty cards (e.g., a cut card, bonus cards, wild cards, or other specialty cards). In some embodiments, the card-handling device 204 may present individual cards, one at a time, for withdrawal from the card-handling device 204. In other embodiments, the card-handling device 204 may present packets of cards representing a subset of the complete set of cards handled by the card-handling device 204 (e.g., individual hands, one hand at a time, a group of hands, a partial hand or hands and then additional cards as needed to complete the hand or hands, a hand or hands and any burn or specialty cards to be used in the same round as the hand or hands) for withdrawal from the card-handling device 204. In some such embodiments, the card-handling device 204 may accept dealer input, such as, for example, a number of replacement cards for discarded cards, a number of hit cards to add, or a number of partial hands to be completed. In other such embodiments, the device may accept a dealer input from a menu of game options indicating a game selection, which will select programming to deliver the requisite number of cards to the game, depending on the game rules. The game rules may be programmed into the memory of the shuffler processing system. In still other embodiments, the card-handling device 204 may present the complete set of randomized cards for withdrawal from the card-handling device 204. As specific, nonlimiting examples, the card-handling device 204 may present a packet of cards representing a partial hand, a single hand, or a group of hands, each hand or partial hand including, for example, two or more cards, as described previously in connection with FIGS. 1A and 1B.

Packets of cards used as player hands, partial player hands, dealer hands, partial dealer hands, community cards, or other card groups may be formed internally within the shuffler, such as within an internal compartment, as described in the '574 patent, or may be formed in an output tray of the shuffler. For example, U.S. Pat. No. 6,698,756, issued Mar. 2, 2004, to Baker et al. describes such a device. Other suitable shufflers include U.S. Pat. No. 6,267,248, issued Jul. 31, 2001, to Johnson et al, which describes a shuffler that can form a random set of cards, such as a deck or multiple decks, U.S. Pat. No. 7,766,332, issued Aug. 3, 2010, to Grauzer et al., which describes forming groups of player and/or dealer cards in compartments within a shuffler; U.S. Patent App. Pub. No. 2014/0027979, published Jan. 30, 2014, to Stasson et al., now U.S. Pat. No. 8,960,674, issued Feb. 24, 2015, which shows an alternative method of randomly forming a set of cards in a shuffler such as one or more decks of cards; and U.S. Pat. No. 6,588,750, issued Jul. 8, 2003, to Grauzer et al., which shows a device for randomizing a set of cards using a gripping, lifting and insertion sequence. The disclosure of each of the foregoing documents is incorporated herein in its entirety by this reference.

In some embodiments, the card-handling device 204 may employ a random number generator device to determine card order, such as, for example, a final card order or an order of insertion of cards into a compartment configured to form a packet of cards. The compartments may be sequentially numbered, and a random number assigned to each compartment number prior to delivery of the first card. In other embodiments, the random number generator may select a location in the stack of cards to separate the stack into two sub-stacks, creating an insertion point within the stack at a random location. The next card may be inserted into the insertion point. In yet other embodiments, the random number generator may randomly select a location in a stack to randomly remove cards by activating an ejector.

Other functions of the random number generator may be game-specific. For example, a random number generator internal or external to the shuffler may be used to randomly select a player to receive a first packet of cards, including a hand or a portion of a hand, according to the game rules. In other examples, the random number generator may select a game position to receive an extra card, one less card, or a random number of cards, depending upon the specific rules of the game.

Regardless of whether the random number generator is hardware or software, it may be used to implement specific game administrations methods of the present disclosure.

The card-handling device 204 may simply be supported on the gaming surface 202 in some embodiments. In other embodiments, the card-handling device 204 may be mounted into the gaming table 202 such that the card-handling device 204 is not manually removable from the gaming table 202 without the use of tools. In some embodiments, the deck or decks of playing cards used may be standard, fifty-two-card decks. In other embodiments, the deck or decks used may include cards, such as, for example, jokers, wild cards, bonus cards, etc. The shuffler may also be configured to handle and dispense security cards, such as cut cards.

In some embodiments, the card-handling device 204 may include an electronic display 207 for displaying information related to the wagering game being administered. For example, the electronic display 207 may display a menu of game options, the name of the game selected, the number of cards per hand to be dispensed, acceptable amounts for wagers (e.g., maximums and minimums), numbers of cards to be dealt to recipients, locations of particular recipients for particular cards, winning and losing wagers, pay tables, winning hands, losing hands, and payout amounts. In other embodiments, information related to the wagering game may be displayed on another electronic display, such as, for example, the display 210 described previously.

The type of card-handling device 204 employed to administer embodiments of the disclosed wagering game, as well as the type of card deck employed and the number of decks, may be specific the game to be implemented. Cards used in games of this disclosure may be, for example, standard playing cards from one or more decks, each deck having cards of four suits (clubs, hearts, diamonds, and spades) and of rankings ace, king, queen, jack, and ten through two in descending order. As a more specific example, six, seven, or eight standard decks of such cards may be intermixed. Typically, six or eight decks of fifty-two standard playing cards each may be intermixed and formed into a set. A suitable device employing random number generation for card management and randomization is marketed under the name MD3® by Bally Gaming, Inc. of Las Vegas, Nev. Aspects of this device are described in U.S. Pat. No. 8,579,289, issued Nov. 12, 2013, to Rynda et al., and the shuffling mechanism is fully described in U.S. Pat. No. 7,677,565, issued Mar. 16, 2010, to Grauzer et al., the disclosure of each of which is incorporated herein in its entirety by this reference. After shuffling, the randomized set may be transferred into another portion of the card-handling device 204B or another card-handling device 204A altogether, such as a mechanized shoe capable of reading card rank and suit. More specifically, the shoe disclosed in, for example, U.S. Pat. No. 8,511,684, issued Aug. 20, 2013, to Grauzer et al., the disclosure of which is incorporated herein in its entirety by this reference, may be used to automatically dispense one or more cards at a time from the randomized set.

As a specific, nonlimiting example, a card shuffler may be used to automatically deliver randomized cards, one at a time or in packets (e.g., packets of two), which may be distributed to the player hand(s), a dealer hand, and any community cards. At least one deck of at least fifty-two standard playing cards may be randomized by the card shuffler. More specifically, the set of cards randomized by the shuffler may include, for example, one deck of fifty-two standard playing cards (i.e., two through ten, jack, queen, king, and ace in each of spades, diamonds, clubs, and hearts), multiple decks of fifty-two standard playing cards (e.g., two, four, six, or eight decks), or one or more decks of fifty-two standard playing cards and additional cards (e.g., wild cards, bonus cards, jokers, cut cards, security cards). Where the cards are delivered to players one at a time, the dealer may input the number of players participating in the base game for determination of the applicable second wager pay table. As described, other sensors may be used. Where the cards are pre-arranged by the shuffler into initial hand packets, the device may automatically determine the number of hands pursuant to a dealer input or removal of the packets and send the signal for derivation and display of the appropriate pay table. In some embodiments, a dealer may input a "stop" command into the shuffler after the required number of packets of randomly arranged cards are dispensed. Afterward, the remaining unused cards may unload into the output tray.

The gaming table 200 may include one or more chip racks 208 configured to facilitate accepting wagers, transferring lost wagers to the house, and exchanging monetary value for wagering elements 212 (e.g., chips). For example, the chip rack 208 may include a series of token support rows, each of which may support tokens of a different type (e.g., color and denomination). In some embodiments, the chip rack 208 may be configured to automatically present a selected number of chips using a chip-cutting-and-delivery mechanism. Additional details of an illustrative chip rack 208 and chip-cutting-and-delivery mechanism are found in U.S. Pat. No. 7,934,980, issued May 3, 2011, to Blaha et al., the disclosure of which is incorporated herein in its entirety by this reference. In some embodiments, the gaming table 200 may include a drop box 214 for money (e.g., paper currency) that is accepted in exchange for wagering elements 212. The drop box 214 may be, for example, a secure container (e.g., a safe or lockbox) having a one-way opening into which money may be inserted and a secure, lockable opening from which money may be retrieved. Such drop boxes 214 are known in the art, and may be incorporated directly into the gaming table 200 and may, in some embodiments, have a removable container for the retrieval of money in a separate, secure location.

When administering a wagering game in accordance with embodiments of this disclosure, a dealer 216 may receive money (e.g., cash) from a player in exchange for wagering elements 212. The dealer 216 may deposit the money in the drop box 214 and transfer physical wagering elements 212 to the player. The dealer 216 may accept one or more initial wagers (e.g., antes, side wagers, and other wagers) from the player, which may be reflected by the dealer 216 permitting the player to place one or more wagering elements 212 or other wagering tokens (e.g., cash) within designated areas on the gaming surface 202 associated with the various wagers of the wagering game. Once initial wagers have been accepted, the dealer 216 may remove physical cards 206 from the card-handling device 204 (e.g., individual cards, packets of cards, or the complete set of cards) in some embodiments. In other embodiments, the physical cards 206 may be hand-pitched (i.e., the dealer 216 may optionally shuffle the cards 206 to randomize the set and may hand-deal cards 206 from the randomized set of cards). The dealer 216 may position cards 206 within designated areas on the gaming surface 202, which may designate the cards 206 for use as individual player cards, community cards, or dealer cards in accordance with game rules. House rules also may allow the player to place wagers before card distribution, during card distribution, or after card distribution, but before revealing the cards. In one embodiment, the dynamic pay table may be displayed after card distribution.

After dealing the cards 206, and during play, according to the game rules, any additional wagers (e.g., play bets) may be accepted pursuant to base game rules, which may be reflected by the dealer 216 permitting the player to place one or more wagering elements 212 within designated areas on the gaming surface 202 associated with the various wagers of the wagering game. In some embodiments, a player may fold, which may result in the dealer 216 collecting at least one of the wagering elements 212 from that player and transferring it to the house, which may be reflected by the wagering element 212 being returned to the chip rack 208. The dealer 216 may perform any additional card dealing and rounds of betting permitted in the wagering game. Finally, the dealer 216 may resolve the wagers, award winning wagers to the players, which may be accomplished by giving wagering elements 212 from the chip rack 208 to the players, and transferring losing wagers to the house, which may be accomplished by moving wagering elements 212 from the players to the chip rack 208.

Figure 4:
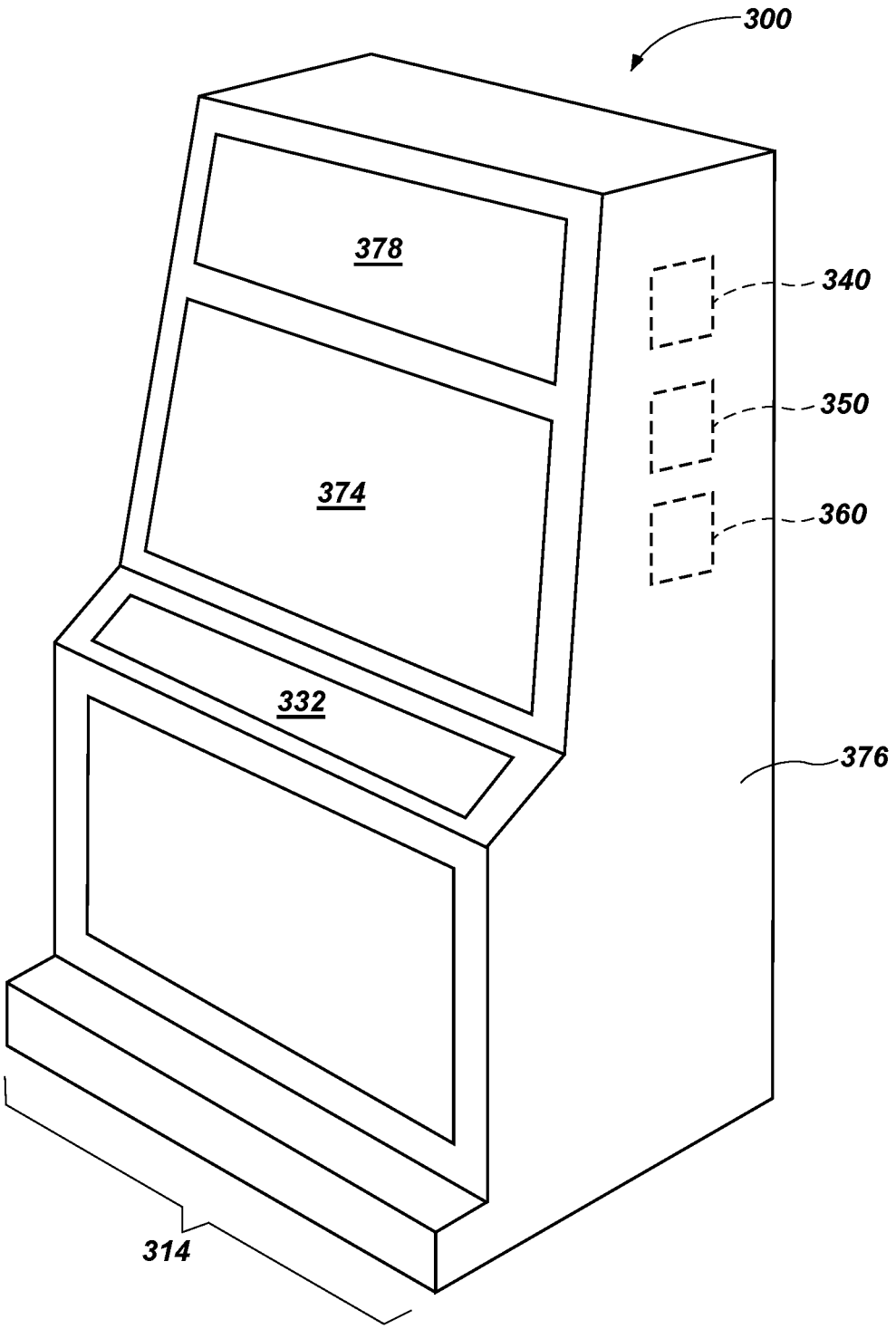
FIG. 4 is a perspective view of an individual electronic gaming device configured for implementation of embodiments of wagering games in accordance with this disclosure.

FIG. 4 is a perspective view of an individual electronic gaming device 300 (e.g., an electronic gaming machine (EGM)) configured for implementing wagering games according to this disclosure. The individual electronic gaming device 300 may include an individual player position 314 including a player input area 332 configured to enable a player to interact with the individual electronic gaming device 300 through various input devices (e.g., buttons, levers, touchscreens). The individual electronic gaming device 300 may include a gaming screen 374 configured to display indicia for interacting with the individual electronic gaming device 300, such as through processing one or more programs stored in memory 340 to implement the rules of game play at the individual electronic gaming device 300. Accordingly, game play may be accommodated without involving physical playing cards, chips or other wagering elements, and live personnel. The action may instead be simulated by a control processor 350 operably coupled to the memory 340 and interacting with and controlling the individual electronic gaming device 300. A number of individual EGM devices may be linked for community play of a wagering game, such as ULTIMATE TEXAS HOLD 'EM® poker. Players may make a base game wager and an optional secondary wager to participate in the game. A dynamic pay table corresponding to the number of eligible players (or hands) may be displayed. All players who made the secondary wager may win when one of the eligible hands qualifies for a secondary game payout.

Although the individual electronic gaming device 300 displayed in FIG. 4 has an outline of a traditional gaming cabinet, the individual electronic gaming device 300 may be implemented in other ways, such as, for example, client software downloaded to a portable device, such as a smart phone, tablet, or laptop computer. The individual electronic gaming device 300 may also be a non-portable personal computer (e.g., a desktop or all-in-one computer) or other computing device. In some embodiments, client software is not downloaded but is native to the device or is otherwise delivered with the device when distributed.

A communication device 360 may be included and operably coupled to the processor 350 such that information related to operation of the individual electronic gaming device 300, information related to the game play, or combinations thereof may be communicated between the individual electronic gaming device 300 and other devices, such as a server, through a suitable communication medium, such, as, for example, wired networks, Wi-Fi networks, and cellular communication networks.

The gaming screen 374 may be carried by a generally vertically extending cabinet 376 of the individual electronic gaming device 300. The individual electronic gaming device 300 may further include banners to communicate rules of game play and the like, such as along a top portion 378 of the cabinet 376 of the individual electronic gaming device 300. The individual electronic gaming device 300 may further include additional decorative lights (not shown), and speakers (not shown) for transmitting and optionally receiving sounds during game play. Further detail of an example of an individual electronic gaming device 300 (as well as other embodiments of tables and devices) is disclosed in U.S. patent application Ser. No. 13/963,165, filed Aug. 9, 2013, now U.S. Pat. No. 9,483,915, issued Nov. 1, 2016, and titled "METHODS AND SYSTEMS FOR ELECTRONIC GAMING," the disclosure of which is incorporated herein in its entirety by this reference.

Some embodiments may be implemented at locations including a plurality of player stations. Such player stations may include an electronic display screen for display of game information (e.g., cards, wagers, and game instructions) and for accepting wagers and facilitating credit balance adjustments. Such player stations may, optionally, be integrated in a table format, may be distributed throughout a casino or other gaming site, or may include both grouped and distributed player stations.

Figure 5:
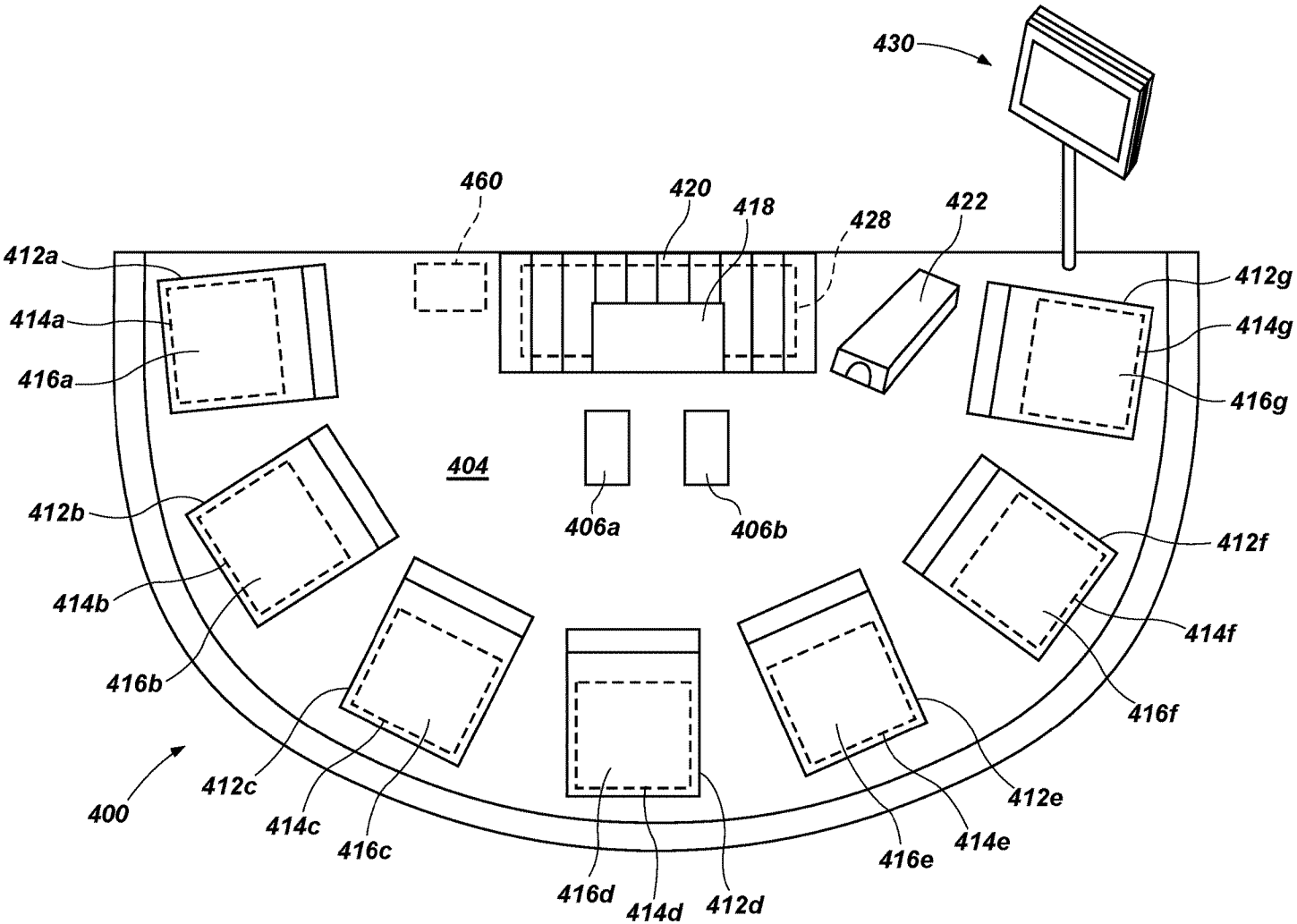
FIG. 5 is a top view of a table configured for implementation of embodiments of wagering games in accordance with this disclosure.

FIG. 5 is a top view of a suitable table 400 (e.g., a hybrid table) configured for implementing wagering games according to this disclosure. The table 400 may include a playing surface 404. The table 400 may include player stations 412. Each player station 412 may include a player interface 416, which may be used for displaying game information (e.g., game instructions, input options, wager information, game outcomes, etc.) and accepting player elections. The player interface 416 may be a display screen in the form of a touchscreen, which may be at least substantially flush with the playing surface 404 in some embodiments. Each player interface 416 may be operated by its own local game processor 414 (shown in dashed lines), although, in some embodiments, a central game processor 428 (shown in dashed lines) may be employed and may communicate directly with player interfaces 416. In some embodiments, a combination of individual local game processors 414 and the central game processor 428 may be employed. Each of the processors 414 and 428 may be operably coupled to memory including one or more programs related to the rules of game play at the table 400.

A communication device 460 (see FIG. 2) may be included and may be operably coupled to one or more of the local game processors 414, the central game processor 428, or combinations thereof, such that information related to operation of the table 400, information related to the game play, or combinations thereof may be communicated between the table 400 and other devices through a suitable communication medium, such as, for example, wired networks, Wi-Fi networks, and cellular communication networks.

The table 400 may further include additional features, such as a dealer chip tray 420, which may be used by the dealer to cash players in and out of the wagering game, whereas wagers and balance adjustments during game play may be performed using, for example, virtual chips (e.g., images or text representing wagers). For embodiments using physical cards 406*a* and 406*b*, the table 400 may further include a card-handling device 422, which may be configured to shuffle, read, and deliver physical cards for the dealer and players to use during game play or, alternatively, a card shoe configured to read and deliver cards that have already been randomized. For embodiments using virtual cards, the virtual cards may be displayed at the individual player interfaces 416. Common virtual cards may be displayed in a common card area.

The table 400 may further include a dealer interface 418, which, like the player interfaces 416, may include touchscreen controls for receiving dealer inputs and assisting the dealer in administering the wagering game. The table 400 may further include an upright display 430 configured to display images that depict game information such as pay tables, hand counts, historical win/loss information by player, and a wide variety of other information considered useful to the players. The upright display 430 may be double sided to provide such information to players as well as to casino personnel.

Further detail of an example of a table and player displays is disclosed in U.S. Pat. No. 8,262,475, issued Sep. 11, 2012, and titled "CHIPLESS TABLE SPLIT SCREEN FEATURE," the disclosure of which is incorporated herein in its entirety by this reference. Although an embodiment is described showing individual discrete player stations, in some embodiments, the entire playing surface 404 may be an electronic display that is logically partitioned to permit game play from a plurality of players for receiving inputs from, and displaying game information to, the players, the dealer, or both.

Figure 6:
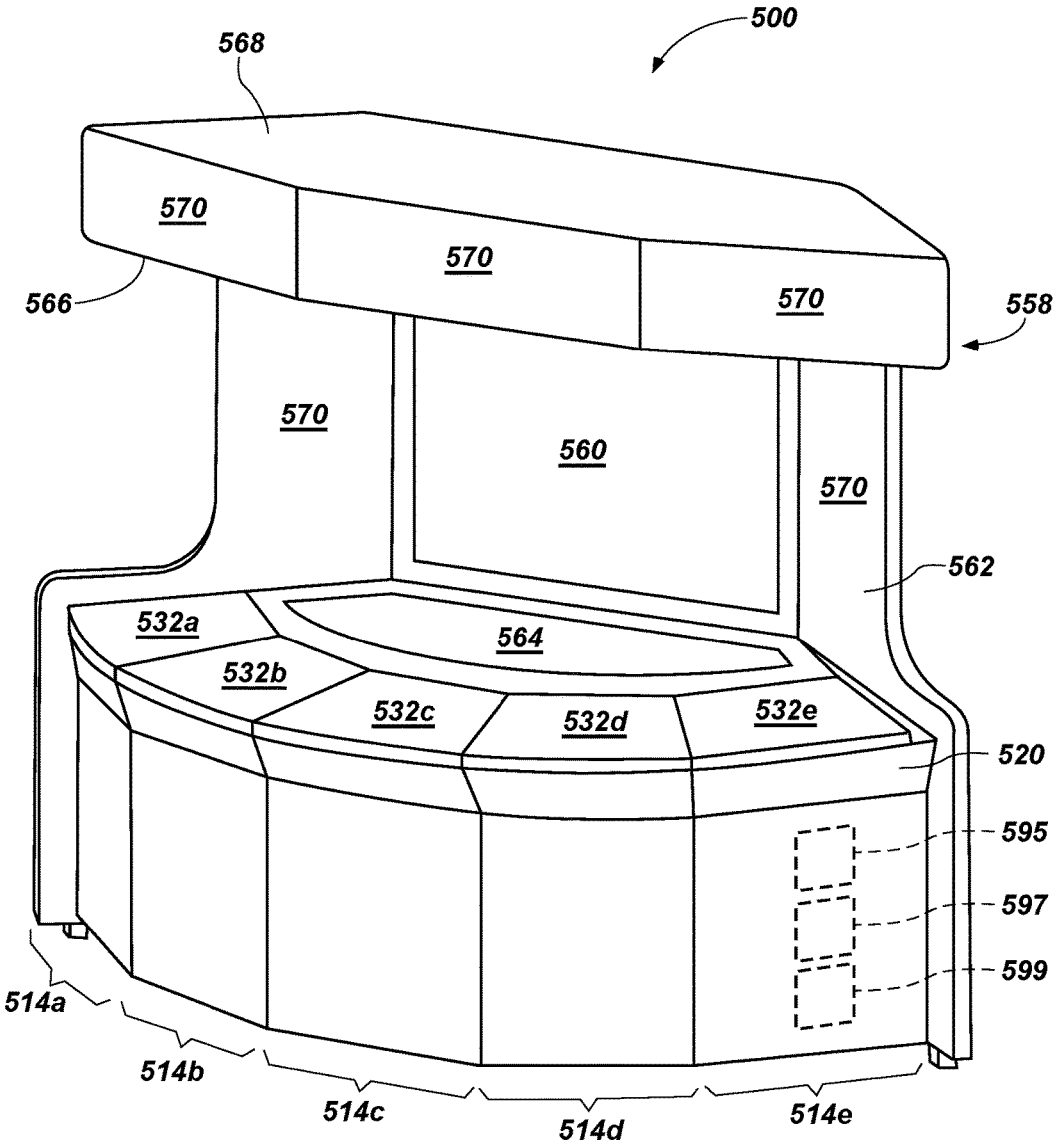
FIG. 6 is a perspective view of another embodiment of a table configured for implementation of embodiments of wagering games in accordance with this disclosure, wherein the implementation includes a virtual dealer.

FIG. 6 is a perspective view of another embodiment of a suitable table 500 (e.g., an electronic, virtual table) configured for implementing wagering games according to the present disclosure utilizing a virtual dealer. The table 500 may include player positions 514 arranged in a bank about an arcuate edge 520 of a video device 558 that may comprise a card screen 564 and a dealer screen 560. The dealer screen 560 may display a video simulation of the dealer (i.e., a virtual dealer) for interacting with the video device 558, such as through processing one or more stored programs stored in memory 595 to implement the rules of game play at the video device 558. The dealer screen 560 may be carried by a generally vertically extending cabinet 562 of the video device 558. The card screen 564 may be configured to display at least one or more of the dealer's cards, any community cards, and player's cards by the virtual dealer on the dealer screen 560.

Each of the player positions 514 may include a player interface area 532 configured for wagering and game play interactions with the video device 558 and virtual dealer. Accordingly, game play may be accommodated without involving physical playing cards, poker chips, and live personnel. The action may instead be simulated by a control processor 597 interacting with and controlling the video device 558. The control processor 597 may be programmed, by known techniques, to implement the rules of game play at the video device 558. As such, the control processor 597 may interact and communicate with display/input interfaces and data entry inputs for each player interface area 532 of the video device 558. Other embodiments of tables and gaming devices may include a control processor that may be similarly adapted to the specific configuration of its associated device.

A communication device 599 may be included and operably coupled to the control processor 597 such that information related to operation of the table 500, information related to the game play, or combinations thereof may be communicated between the table 500 and other devices, such as a central server, through a suitable communication medium, such, as, for example, wired networks, Wi-Fi networks, and cellular communication networks.

The video device 558 may further include banners communicating rules of play and the like, which may be located along one or more walls 570 of the cabinet 562. The video device 558 may further include additional decorative lights and speakers, which may be located on an underside surface 566, for example, of a generally horizontally extending top 568 of the cabinet 562 of the video device 558 generally extending toward the player positions 514.

Further detail of an example of a table and player displays is disclosed in U.S. Pat. No. 8,272,958, issued Sep. 25, 2012, and titled "AUTOMATED MULTIPLAYER GAME TABLE WITH UNIQUE IMAGE FEED OF DEALER," the disclosure of which is incorporated herein in its entirety by this reference. Although an embodiment is described showing individual discrete player stations, in some embodiments, the entire playing surface (e.g., player interface areas 532, card screen 564, etc.) may be a unitary electronic display that is logically partitioned to permit game play from a plurality of players for receiving inputs from, and displaying game information to, the players, the dealer, or both.

Figure 7:
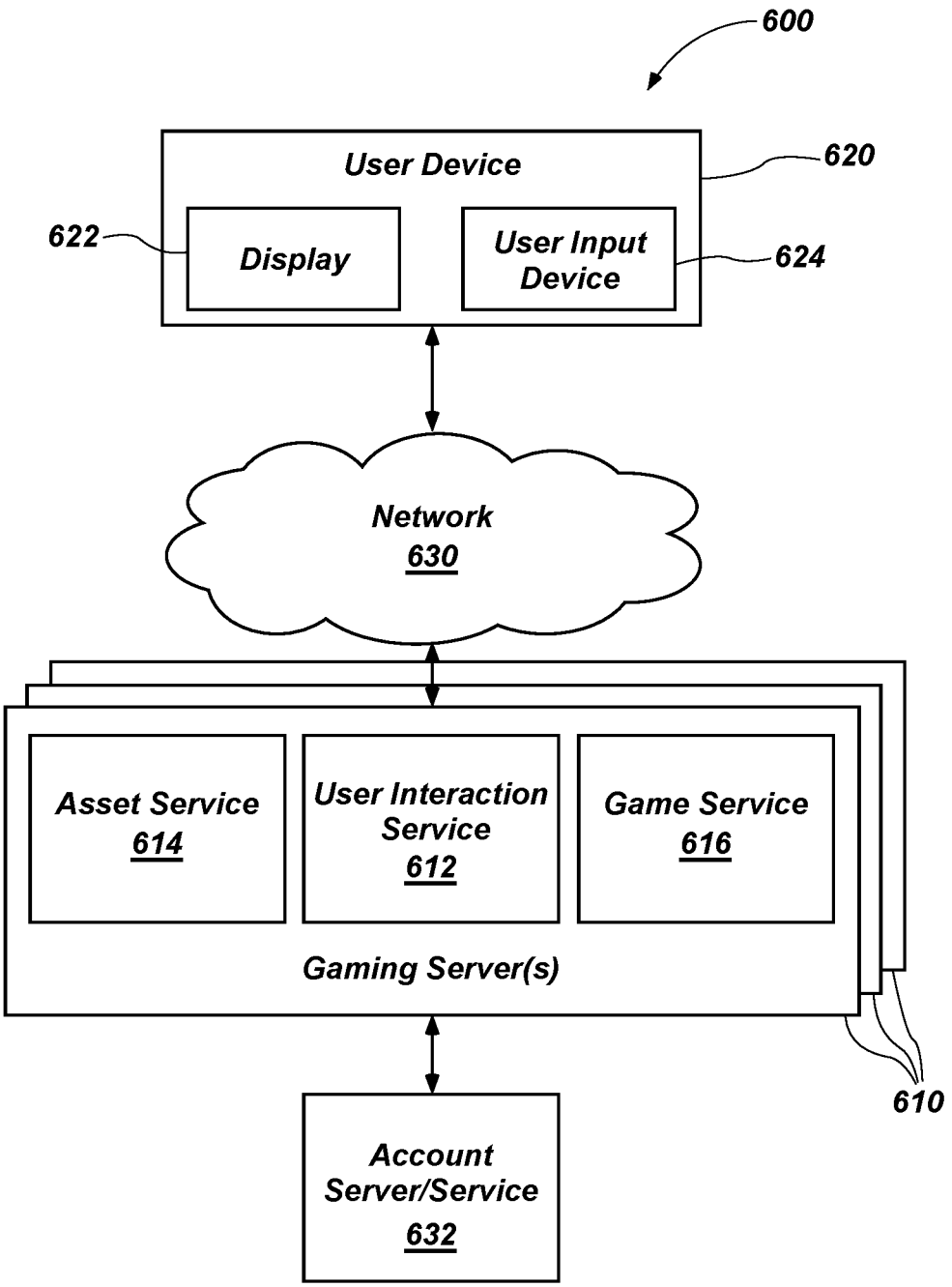
FIG. 7 is a schematic block diagram of a gaming system for implementing embodiments of wagering games in accordance with this disclosure.

In some embodiments, wagering games in accordance with this disclosure may be administered using a gaming system employing a client-server architecture (e.g., over the Internet, a local area network, etc.). FIG. 7 is a schematic block diagram of an illustrative gaming system 600 for implementing wagering games according to this disclosure. The gaming system 600 may enable end users to remotely access game content. Such game content may include, without limitation, various types of wagering games such as card games, dice games, big wheel games, roulette, scratch off games ("scratchers"), and any other wagering game where the game outcome is determined, in whole or in part, by one or more random events. This includes, but is not limited to, Class II and Class III games as defined under 25 U.S.C. § 2701 et seq. ("Indian Gaming Regulatory Act"). Such games may include banked and/or non-banked games.

The wagering games supported by the gaming system 600 may be operated with real currency or with virtual credits or other virtual (e.g., electronic) value indicia. For example, the real currency option may be used with traditional casino and lottery-type wagering games in which money or other items of value are wagered and may be cashed out at the end of a game session. The virtual credits option may be used with wagering games in which credits (or other symbols) may be issued to a player to be used for the wagers. A player may be credited with credits in any way allowed, including, but not limited to, a player purchasing credits; being awarded credits as part of a contest or a win event in this or another game (including non-wagering games); being awarded credits as a reward for use of a product, casino, or other enterprise, time played in one session, or games played; or may be as simple as being awarded virtual credits upon logging in at a particular time or with a particular frequency, etc. Although credits may be won or lost, the ability of the player to cash out credits may be controlled or prevented. In one example, credits acquired (e.g., purchased or awarded) for use in a play-for-fun game may be limited to non-monetary redemption items, awards, or credits usable in the future or for another game or gaming session. The same credit redemption restrictions may be applied to some or all of credits won in a wagering game as well.

An additional variation includes web-based sites having both play-for-fun and wagering games, including issuance of free (non-monetary) credits usable to play the play-for-fun games. This feature may attract players to the site and to the games before they engage in wagering. In some embodiments, a limited number of free or promotional credits may be issued to entice players to play the games. Another method of issuing credits includes issuing free credits in exchange for identifying friends who may want to play. In another embodiment, additional credits may be issued after a period of time has elapsed to encourage the player to resume playing the game. The gaming system 600 may enable players to buy additional game credits to allow the player to resume play. Objects of value may be awarded to play-for-fun players, which may or may not be in a direct exchange for credits. For example, a prize may be awarded or won for a highest scoring play-for-fun player during a defined time interval. All variations of credit redemption are contemplated, as desired by game designers and game hosts (the person or entity controlling the hosting systems).

The gaming system 600 may include a gaming platform to establish a portal for an end user to access a wagering game hosted by one or more gaming servers 610 over a network 630. In some embodiments, games are accessed through a user interaction service 612. The gaming system 600 enables players to interact with a user device 620 through a user input device 624 and a display 622 and to communicate with one or more gaming servers 610 using a network 630 (e.g., the Internet). Typically, the user device 620 is remote from the gaming server 610 and the network 630 is the word-wide web (i.e., the Internet). To maintain attractive awards for the second wager, participating players may be grouped into manageable groups, such as selectable groups of up to six players simulating play at a physical table.

In some embodiments, the gaming servers 610 may be configured as a single server to administer wagering games in combination with the user device 620. In other embodiments, the gaming servers 610 may be configured as separate servers for performing separate, dedicated functions associated with administering wagering games. Accordingly, the following description also discusses "services" with the understanding that the various services may be performed by different servers or combinations of servers in different embodiments. As shown in FIG. 7, the gaming servers 610 may include a user interaction service 612, a game service 616, and an asset service 614. In some embodiments, one or more of the gaming servers 610 may communicate with an account server 632 performing an account service 632. As explained more fully below, for some wagering type games, the account service 632 may be separate and operated by a different entity than the gaming servers 610; however, in some embodiments the account service 632 may also be operated by one or more of the gaming servers 610.

The user device 620 may communicate with the user interaction service 612 through the network 630. The user interaction service 612 may communicate with the game service 616 and provide game information to the user device 620. In some embodiments, the game service 616 may also include a game engine. The game engine may, for example, access, interpret, and apply game rules. In some embodiments, a single user device 620 communicates with a game provided by the game service 616, while other embodiments may include a plurality of user devices 620 configured to communicate and provide end users with access to the same game provided by the game service 616. In addition, a plurality of end users may be permitted to access a single user interaction service 612, or a plurality of user interaction services 612, to access the game service 616. The user interaction service 612 may enable a user to create and access a user account and interact with game service 616. The user interaction service 612 may enable users to initiate new games, join existing games, and interface with games being played by the user.

The user interaction service 612 may also provide a client for execution on the user device 620 for accessing the gaming servers 610. The client provided by the gaming servers 610 for execution on the user device 620 may be any of a variety of implementations depending on the user device 620 and method of communication with the gaming servers 610. In one embodiment, the user device 620 may connect to the gaming servers 610 using a web browser, and the client may execute within a browser window or frame of the web browser. In another embodiment, the client may be a stand-alone executable on the user device 620.

For example, the client may comprise a relatively small amount of script (e.g., JAVASCRIPT®), also referred to as a "script driver," including scripting language that controls an interface of the client. The script driver may include simple function calls requesting information from the gaming servers 610. In other words, the script driver stored in the client may merely include calls to functions that are externally defined by, and executed by, the gaming servers 610. As a result, the client may be characterized as a "thin client." The client may simply send requests to the gaming servers 610 rather than performing logic itself. The client may receive player inputs, and the player inputs may be passed to the gaming servers 610 for processing and executing the wagering game. In some embodiments, this may involve providing specific graphical display information for the display 622 as well as game outcomes.

As another example, the client may comprise an executable file rather than a script. The client may do more local processing than does a script driver, such as calculating where to show what game symbols upon receiving a game outcome from the game service 616 through user interaction service 612. In some embodiments, portions of an asset service 614 may be loaded onto the client and may be used by the client in processing and updating graphical displays. Some form of data protection, such as end-to-end encryption, may be used when data is transported over the network 630. The network 630 may be any network, such as, for example, the Internet or a local area network.

The gaming servers 610 may include an asset service 614, which may host various media assets (e.g., text, audio, video, and image files) to send to the user device 620 for presenting the various wagering games to the end user. In other words, the assets presented to the end user may be stored separately from the user device 620. For example, the user device 620 requests the assets appropriate for the game played by the user; as another example, especially relating to thin clients, just those assets that are needed for a particular display event will be sent by the gaming servers 610, including as few as one asset. The user device 620 may call a function defined at the user interaction service 612 or asset service 614, which may determine which assets are to be delivered to the user device 620 as well as how the assets are to be presented by the user device 620 to the end user. Different assets may correspond to the various user devices 620 and their clients that may have access to the game service 616 and to different variations of wagering games.

The gaming servers 610 may include the game service 616, which may be programmed to administer wagering games and determine game play outcomes to provide to the user interaction service 612 for transmission to the user device 620. For example, the game service 616 may include game rules for one or more wagering games, such that the game service 616 controls some or all of the game flow for a selected wagering game as well as the determined game outcomes. The game service 616 may include pay tables and other game logic. The game service 616 may perform random number generation for determining random game elements of the wagering game. In one embodiment, the game service 616 may be separated from the user interaction service 612 by a firewall or other method of preventing unauthorized access to the game service 612 by the general members of the network 630.

The user device 620 may present a gaming interface to the player and communicate the user interaction from the user input device 624 to the gaming servers 610. The user device 620 may be any electronic system capable of displaying gaming information, receiving user input, and communicating the user input to the gaming servers 610. For example, the user device 620 may be a desktop computer, a laptop, a tablet computer, a set-top box, a mobile device (e.g., a smartphone), a kiosk, a terminal, or another computing device. As a specific, nonlimiting example, the user device 620 operating the client may be an interactive electronic gaming system 300 (see FIG. 4), as described above. The client may be a specialized application or may be executed within a generalized application capable of interpreting instructions from an interactive gaming system, such as a web browser.

The client may interface with an end user through a web page or an application that runs on a device including, but not limited to, a smartphone, a tablet, or a general computer, or the client may be any other computer program configurable to access the gaming servers 610. The client may be illustrated within a casino webpage (or other interface) indicating that the client is embedded into a webpage, which is supported by a web browser executing on the user device 620.

In some embodiments, components of the gaming system 600 may be operated by different entities. For example, the user device 620 may be operated by a third party, such as a casino or an individual, that links to the gaming servers 610, which may be operated, for example, by a wagering game service provider. Therefore, in some embodiments, the user device 620 and client may be operated by a different administrator than the operator of the game service 616. In other words, the user device 620 may be part of a third-party system that does not administer or otherwise control the gaming servers 610 or game service 616. In other embodiments, the user interaction service 612 and asset service 614 may be operated by a third-party system. For example, a gaming entity (e.g., a casino) may operate the user interaction service 612, user device 620, or combination thereof to provide its customers access to game content managed by a different entity that may control the game service 616, amongst other functionality. In still other embodiments, all functions may be operated by the same administrator. For example, a gaming entity (e.g., a casino) may elect to perform each of these functions in-house, such as providing access to the user device 620, delivering the actual game content, and administering the gaming system 600.

The gaming servers 610 may communicate with one or more external account servers 632 (also referred to herein as an account service 632), optionally through another firewall. For example, the gaming servers 610 may not directly accept wagers or issue payouts. That is, the gaming servers 610 may facilitate online casino gaming but may not be part of a self-contained online casino itself. Another entity (e.g., a casino or any account holder or financial system of record) may operate and maintain its external account service 632 to accept bets and make payout distributions. The gaming servers 610 may communicate with the account service 632 to verify the existence of funds for wagering and to instruct the account service 632 to execute debits and credits. As another example, the gaming servers 610 may directly accept bets and make payout distributions, such as in the case where an administrator of the gaming servers 610 operates as a casino.

Additional features may be supported by the gaming servers 610, such as hacking and cheating detection, data storage and archival, metrics generation, messages generation, output formatting for different end user devices, as well as other features and operations. For example, the gaming servers 610 may include additional features and configurations as described in U.S. patent application Ser. No. 13/353,194, filed Jan. 18, 2012, now U.S. Pat. No. 9,120,007, issued Sep. 1, 2015, and U.S. patent application Ser. No. 13/609,031, filed Sep. 10, 2012, now U.S. Pat. No. 8,974,305, issued Mar. 10, 2015, both applications titled "NETWORK GAMING ARCHITECTURE, GAMING SYSTEMS, AND RELATED METHODS," the disclosure of each of which is incorporated herein in its entirety by this reference.

In such embodiments, there may be many user devices 620 linked to the table. Typically, the hand dealt to the player is used by all players in a manner inasmuch as, for example, if there were twenty user devices, a large playing card inventory would be required to provide individual hands to each player. Games such as baccarat where there is a single banker hand and a player hand is an example of such a game. U.S. Patent App. Pub. No. 2002/0147042, to Vuong et al., filed Feb. 14, 2001, the disclosure of which is incorporated herein in its entirety by this reference, discloses a blackjack game with a single dealer hand and a player hand which is played by all players.

In some embodiments, players of the user devices 620 may be able to "back bet" at a selected position for a physical player at a live or hybrid table game for the first wager and side wager. They may make a side wager where the physical player has opted to forego making a side wager or may join a selected player by making their own side wager. Winning side bet wagers are paid based upon the odds derived from the number of hands in the base game at the physical table.

Figure 8:
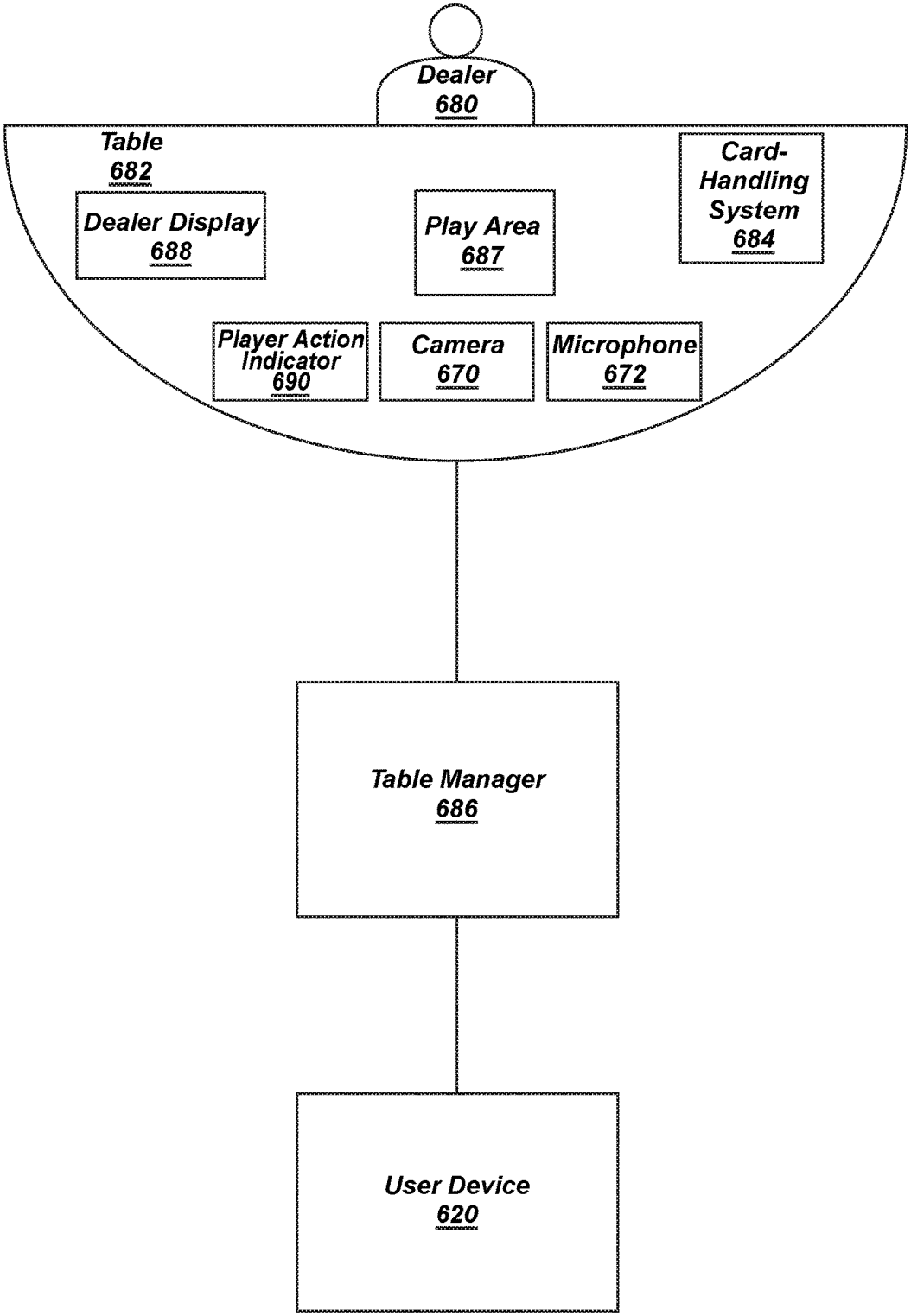
FIG. 8 is a schematic block diagram of a gaming system for implementing embodiments of wagering games including a live dealer feed.

FIG. 8 is a schematic block diagram of a table 682 for implementing wagering games including a live dealer feed. Features of the gaming system 600 (see FIG. 7) described above in connection with FIG. 7 may be utilized in connection with this embodiment, except as further described. Rather than cards being determined by computerized random processes, physical cards (e.g., from a standard, fifty-two-card deck of playing cards) may be dealt by a live dealer 680 at a table 682 from a card-handling system 684. A table manager 686 may assist the dealer 680 in facilitating play of the game by transmitting a video feed of the dealer's actions to the user device 620 and transmitting player elections to the dealer 680. As described above, the table manager 686 may act as or communicate with a gaming system 600 (see FIG. 7) (e.g., acting as the gaming system 600 (see FIG. 7) itself or as an intermediate client interposed between and operationally connected to the user device 620 and the gaming system 600 (see FIG. 7)) to provide gaming at the table 682 to users of the gaming system 600 (see FIG. 7). Thus, the table manager 686 may communicate with the user device 620 through a network 630 (see FIG. 7), and may be a part of a larger online casino, or may be operated as a separate system facilitating game play. In various embodiments, each table 682 may be managed by an individual table manager 686 constituting a gaming device, which may receive and process information relating to that table. For simplicity of description, these functions are described as being performed by the table manager 686, though certain functions may be performed by an intermediary gaming system 600 (see FIG. 7), such as the one shown and described in connection with FIG. 7. In some embodiments, the gaming system 600 (see FIG. 7) may match remotely located players to tables 682 and facilitate transfer of information between user devices 620 and tables 682, such as wagering amounts and player option elections, without managing gameplay at individual tables. In other embodiments, functions of the table manager 686 may be incorporated into a gaming system 600 (see FIG. 7).

The table 682 includes a camera 670 and optionally a microphone 672 to capture video and audio feeds relating to the table 682. The camera 670 may be trained on the dealer 680, play area 687, and card-handling system 684. As the game is administered by the dealer 680, the video feed captured by the camera 670 may be shown to the player using the user device 620, and any audio captured by the microphone 672 may be played to the player using the user device 620. In some embodiments, the user device 620 may also include a camera, microphone, or both, which may also capture feeds to be shared with the dealer 680 and other players. In some embodiments, the camera 670 may be trained to capture images of the card faces, chips, and chip stacks on the surface of the gaming table. Known image extraction techniques may be used to obtain card count and card rank and suit information from the card images. An example of suitable image extraction software is disclosed in U.S. Pat. No. 7,901,285, issued Mar. 8, 2011, to Tran et al., the disclosure of which is incorporated in this disclosure in its entirety by this reference.

Card and wager data in some embodiments may be used by the table manager 686 to determine game outcome. The data extracted from the camera 670 may be used to confirm the card data obtained from the card-handling system 684, to determine a player position that received a card, and for general security monitoring purposes, such as detecting player or dealer card switching, for example. Examples of card data include, for example, suit and rank information of a card, suit and rank information of each card in a hand, rank information of a hand, and rank information of every hand in a round of play.

The live video feed permits the dealer to show cards dealt by the card-handling system 684 and play the game as though the player were at a live casino. In addition, the dealer can prompt a user by announcing a player's election is to be performed. In embodiments where a microphone 672 is included, the dealer 680 can verbally announce action or request an election by a player. In some embodiments, the user device 620 also includes a camera or microphone, which also captures feeds to be shared with the dealer 680 and other players.

The card-handling system 684 may be as shown and described previously in connection with FIG. 3. The play area 687 depicts player positions for playing the game, such as shown in FIG. 2. As determined by the rules of the game, the player at the user device 620 may be presented options for responding to an event in the game using a client as described with reference to FIG. 7.

Player elections may be transmitted to the table manager 686, which may display player elections to the dealer 680 using a dealer display 688 and player action indicator 690 on the table 682. For example, the dealer display 688 may display information regarding where to deal the next card or which player position is responsible for the next action.

In some embodiments, the table manager 686 may receive card information from the card-handling system 684 to identify cards dealt by the card-handling system 684. For example, the card-handling system 684 may include a card reader to determine card information from the cards. The card information may include the rank and suit of each dealt card and hand information.

The table manager 686 may apply game rules to the card information, along with the accepted player decisions, to determine gameplay events and wager results. Alternatively, the wager results may be determined by the dealer 680 and input to the table manager 686, which may be used to confirm automatically determined results by the gaming system.

Card and wager data in some embodiments may be used by the table manager 686 to determine game outcome. The data extracted from the camera 670 may be used to confirm the card data obtained from the card-handling system 684, to determine a player position that received a card, and for general security monitoring purposes, such as detecting player or dealer card switching, for example.

The live video feed permits the dealer to show cards dealt by the card-handling system 684 and play the game as though the player were at a live casino. In addition, the dealer can prompt a user by announcing a player's election is to be performed. In embodiments where a microphone 672 is included, the dealer 680 can verbally announce action or request an election by a player. In some embodiments, the user device 620 also includes a camera or microphone, which also captures feeds to be shared with the dealer 680 and other players.

Figure 9:
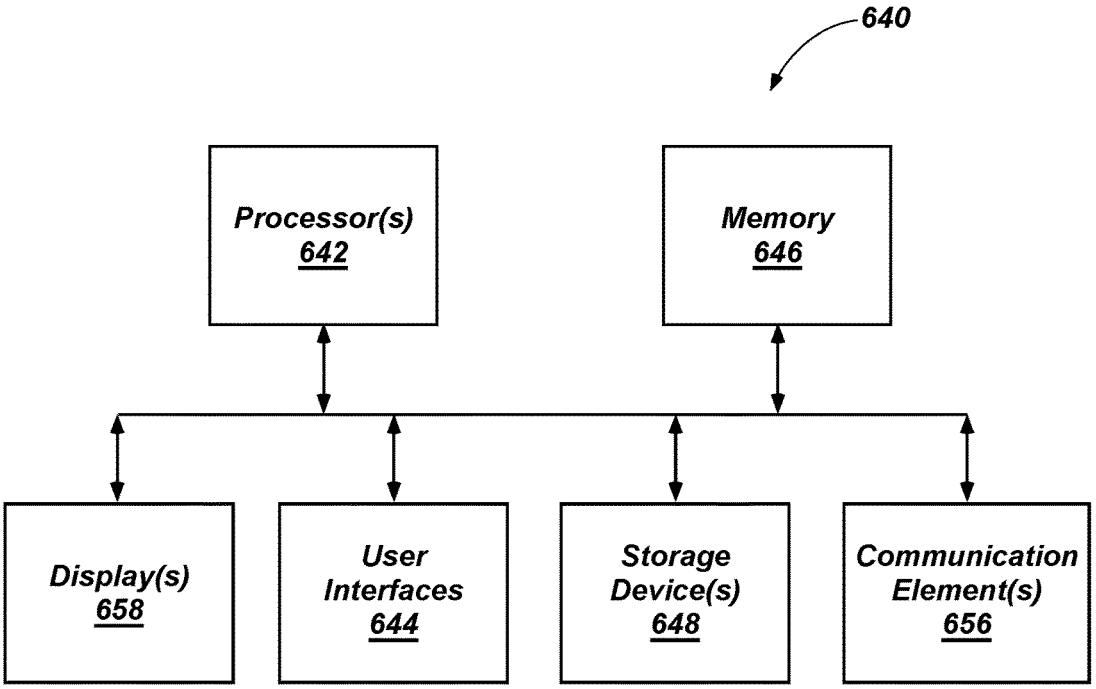
FIG. 9 is a block diagram of a computer for acting as a gaming system for implementing embodiments of wagering games in accordance with this disclosure.

FIG. 9 is a simplified block diagram showing elements of computing devices that may be used in systems and apparatuses of this disclosure. A computing system 640 may be a user-type computer, a file server, a computer server, a notebook computer, a tablet, a handheld device, a mobile device, or other similar computer system for executing software. The computing system 640 may be configured to execute software programs containing computing instructions and may include one or more processors 642, memory 646, one or more displays 658, one or more user interface elements 644, one or more communication elements 656, and one or more storage devices 648 (also referred to herein simply as storage devices 648).

The processors 642 may be configured to execute a wide variety of operating systems and applications including the computing instructions for administering wagering games of the present disclosure.

The processors 642 may be configured as a general-purpose processor such as a microprocessor, but in the alternative, the general-purpose processor may be any processor, controller, microcontroller, or state machine suitable for carrying out processes of the present disclosure. The processor 642 may also be implemented as a combination of computing devices, such as a combination of a DSP and a microprocessor, a plurality of microprocessors, one or more microprocessors in conjunction with a DSP core, or any other such configuration.

A general-purpose processor may be part of a general-purpose computer. However, when configured to execute instructions (e.g., software code) for carrying out embodiments of the present disclosure the general-purpose computer should be considered a special-purpose computer. Moreover, when configured according to embodiments of the present disclosure, such a special-purpose computer improves the function of a general-purpose computer because, absent the present disclosure, the general-purpose computer would not be able to carry out the processes of the present disclosure. The processes of the present disclosure, when carried out by the special-purpose computer, are processes that a human would not be able to perform in a reasonable amount of time due to the complexities of the data processing, decision making, communication, interactive nature, or combinations thereof for the present disclosure. The present disclosure also provides meaningful limitations in one or more particular technical environments that go beyond an abstract idea. For example, embodiments of the present disclosure provide improvements in the technical field related to the present disclosure.

The memory 646 may be used to hold computing instructions, data, and other information for performing a wide variety of tasks including administering wagering games of the present disclosure. By way of example, and not limitation, the memory 646 may include Synchronous Random Access Memory (SRAM), Dynamic RAM (DRAM), Read-Only Memory (ROM), Flash memory, and the like.

The display 658 may be a wide variety of displays such as, for example, light-emitting diode displays, liquid crystal displays, cathode ray tubes, and the like. In addition, the display 658 may be configured with a touchscreen feature for accepting user input as a user interface element 644.

As nonlimiting examples, the user interface elements 644 may include elements such as displays, keyboards, push-buttons, mice, joysticks, haptic devices, microphones, speakers, cameras, and touchscreens.

As nonlimiting examples, the communication elements 656 may be configured for communicating with other devices or communication networks. As nonlimiting examples, the communication elements 656 may include elements for communicating on wired and wireless communication media, such as for example, serial ports, parallel ports, Ethernet connections, universal serial bus (USB) connections, IEEE 1394 ("firewire") connections, THUNDERBOLT™ connections, BLUETOOTH® wireless networks, ZIGBEE® wireless networks, 802.11 type wireless networks, cellular telephone/data networks, and other suitable communication interfaces and protocols.

The storage devices 648 may be used for storing relatively large amounts of nonvolatile information for use in the computing system 640 and may be configured as one or more storage devices. By way of example and not limitation, these storage devices may include computer-readable media (CRM). This CRM may include, but is not limited to, magnetic and optical storage devices such as disk drives, magnetic tape, CDs (compact discs), DVDs (digital versatile discs or digital video discs), and semiconductor devices such as RAM, DRAM, ROM, EPROM, Flash memory, and other equivalent storage devices.

A person of ordinary skill in the art will recognize that the computing system 640 may be configured in many different ways with different types of interconnecting buses between the various elements. Moreover, the various elements may be subdivided physically, functionally, or a combination thereof. As one nonlimiting example, the memory 646 may be divided into cache memory, graphics memory, and main memory. Each of these memories may communicate directly or indirectly with the one or more processors 642 on separate buses, partially combined buses, or a common bus.

As a specific, nonlimiting example, various methods and features of the present disclosure may be implemented in a mobile, remote, or mobile and remote environment over one or more of Internet, cellular communication (e.g., Broadband), near field communication networks and other communication networks referred to collectively herein as an iGaming environment. The iGaming environment may be accessed through social media environments such as FACEBOOK® and the like. DragonPlay Ltd, acquired by Bally Technologies Inc., provides an example of a platform to provide games to user devices, such as cellular telephones and other devices utilizing ANDROID®, iPHONE® and FACEBOOK® platforms. Where permitted by jurisdiction, the iGaming environment can include pay-to-play (P2P) gaming where a player, from their device, can make value based wagers and receive value based awards. Where P2P is not permitted the features can be expressed as entertainment only gaming where players wager virtual credits having no value or risk no wager whatsoever such as playing a promotion game or feature.

Figure 10:
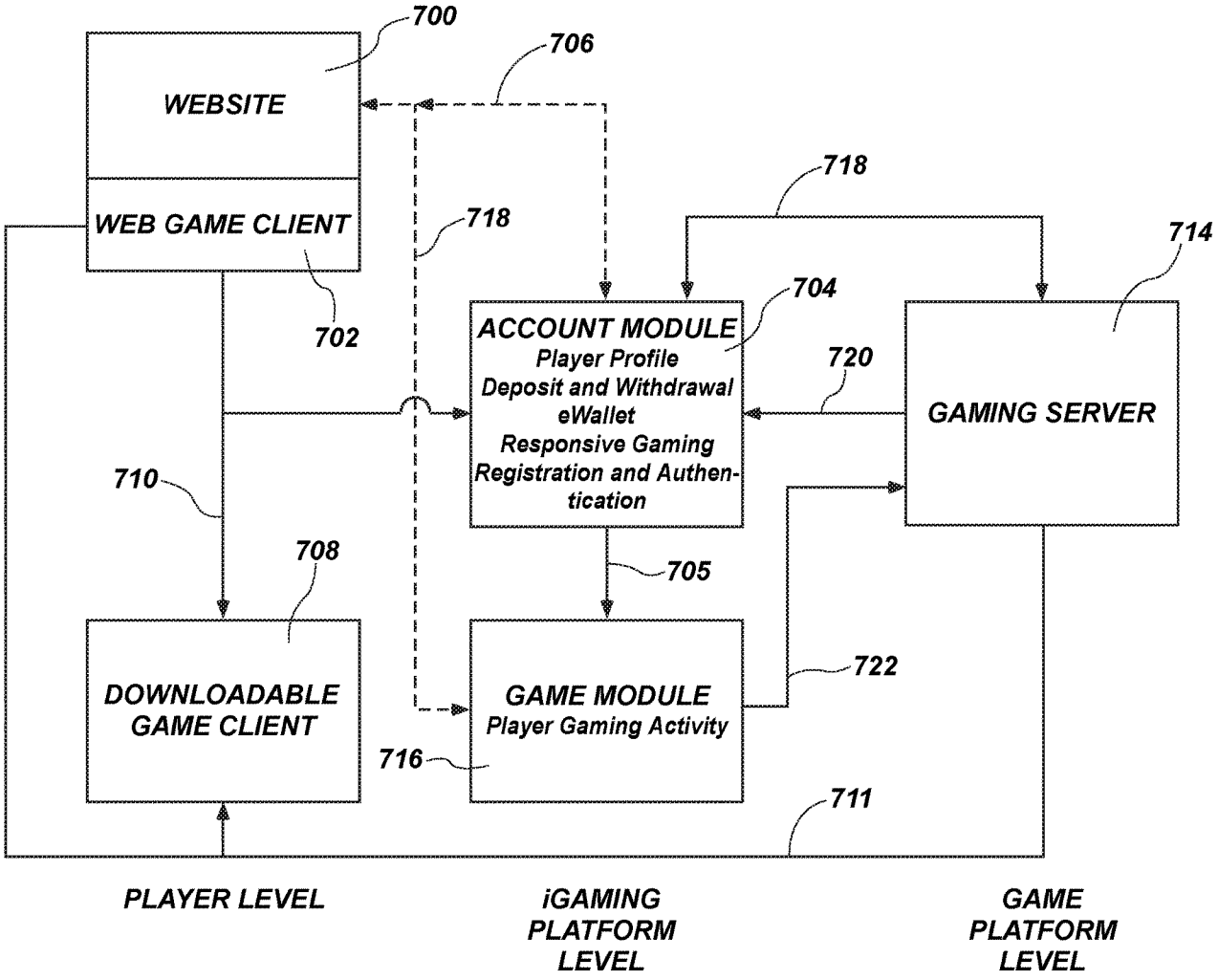
FIG. 10 illustrates an embodiment of data flows between various applications/services for supporting the game, feature or utility of the present disclosure for mobile/interactive gaming.

FIG. 10 illustrates an illustrative embodiment of information flows in an iGaming environment. At a player level, the player or user accesses a site hosting the activity such as a website 700. The website 700 may functionally provide a web game client 702. The web game client 702 may be, for example, represented by a game client 708 downloadable at information flow 710, which may process applets transmitted from a gaming server 714 at information flow 711 for rendering and processing game play at a player's remote device. Where the game is a P2P game, the gaming server 714 may process value-based wagers (e.g., money wagers) and randomly generate an outcome for rendition at the player's device. In some embodiments, the web game client 702 may access a local memory store to drive the graphic display at the player's device. In other embodiments, all or a portion of the game graphics may be streamed to the player's device with the web game client 702 enabling player interaction and display of game features and outcomes at the player's device.

The website 700 may access a player-centric, iGaming-platform-level account module 704 at information flow 706 for the player to establish and confirm credentials for play and, where permitted, access an account (e.g., an eWALLET®) for wagering. The account module 704 may include or access data related to the player's profile (e.g., player-centric information desired to be retained and tracked by the host), the player's electronic account, deposit, and withdrawal records, registration and authentication information, such as username and password, name and address information, date of birth, a copy of a government issued identification document, such as a driver's license or passport, and biometric identification criteria, such as fingerprint or facial recognition data, and a responsible gaming module containing information, such as self-imposed or jurisdictionally imposed gaming restraints, such as loss limits, daily limits and duration limits. The account module 704 may also contain and enforce geo-location limits, such as geographic areas where the player may play P2P games, user device IP address confirmation, and the like.

The account module 704 communicates at information flow 705 with a game module 716 to complete log-ins, registrations, and other activities. The game module 716 may also store or access a player's gaming history, such as player tracking and loyalty club account information. The game module 716 may provide static web pages to the player's device from the game module 716 through information flow 718, whereas, as stated above, the live game content may be provided from the gaming server 714 to the web game client through information flow 711.

The gaming server 714 may be configured to provide interaction between the game and the player, such as receiving wager information, game selection, inter-game player selections or choices to play a game to its conclusion, and the random selection of game outcomes and graphics packages, which, alone or in conjunction with the downloadable game client 708/web game client 702 and game module 716, provide for the display of game graphics and player interactive interfaces. At information flow 718, player account and log-in information may be provided to the gaming server 714 from the account module 704 to enable gaming. Information flow 720 provides wager/credit information between the account module 704 and gaming server 714 for the play of the game and may display credits and eWALLET® availability. Information flow 722 may provide player tracking information for the gaming server 714 for tracking the player's play. The tracking of play may be used for purposes of providing loyalty rewards to a player, determining preferences, and the like.

All or portions of the features of FIG. 10 may be supported by servers and databases located remotely from a player's mobile device and may be hosted or sponsored by regulated gaming entity for P2P gaming or, where P2P is not permitted, for entertainment only play.

Again, to maintain attractive awards for side wagers, iGaming may be operated on a back-betting format with a limited number (e.g., five) of live, remote, or virtual players at a virtual table.

In some embodiments, wagering games may be administered in an at least partially player-pooled format, with payouts on pooled wagers being paid from a pot to players and losses on wagers being collected into the pot and eventually distributed to one or more players. Such player-pooled embodiments may include a player-pooled progressive embodiment, in which a pot is eventually distributed when a predetermined progressive-winning hand combination or composition is dealt. Player-pooled embodiments may also include a dividend refund embodiment, in which at least a portion of the pot is eventually distributed in the form of a refund distributed, e.g., pro-rata, to the players who contributed to the pot.

In some player-pooled embodiments, the game administrator may not obtain profits from chance-based events occurring in the wagering games that result in lost wagers. Instead, lost wagers may be redistributed back to the players. To profit from the wagering game, the game administrator may retain a commission, such as, for example, a player entrance fee or a rake taken on wagers, such that the amount obtained by the game administrator in exchange for hosting the wagering game is limited to the commission and is not based on the chance events occurring in the wagering game itself. The game administrator may also charge a rent or flat fee to participate. Specific, illustrative mechanisms for redistributing the lost wagers back to players are described in connection with FIGS. 12 and 13.

Figure 11:
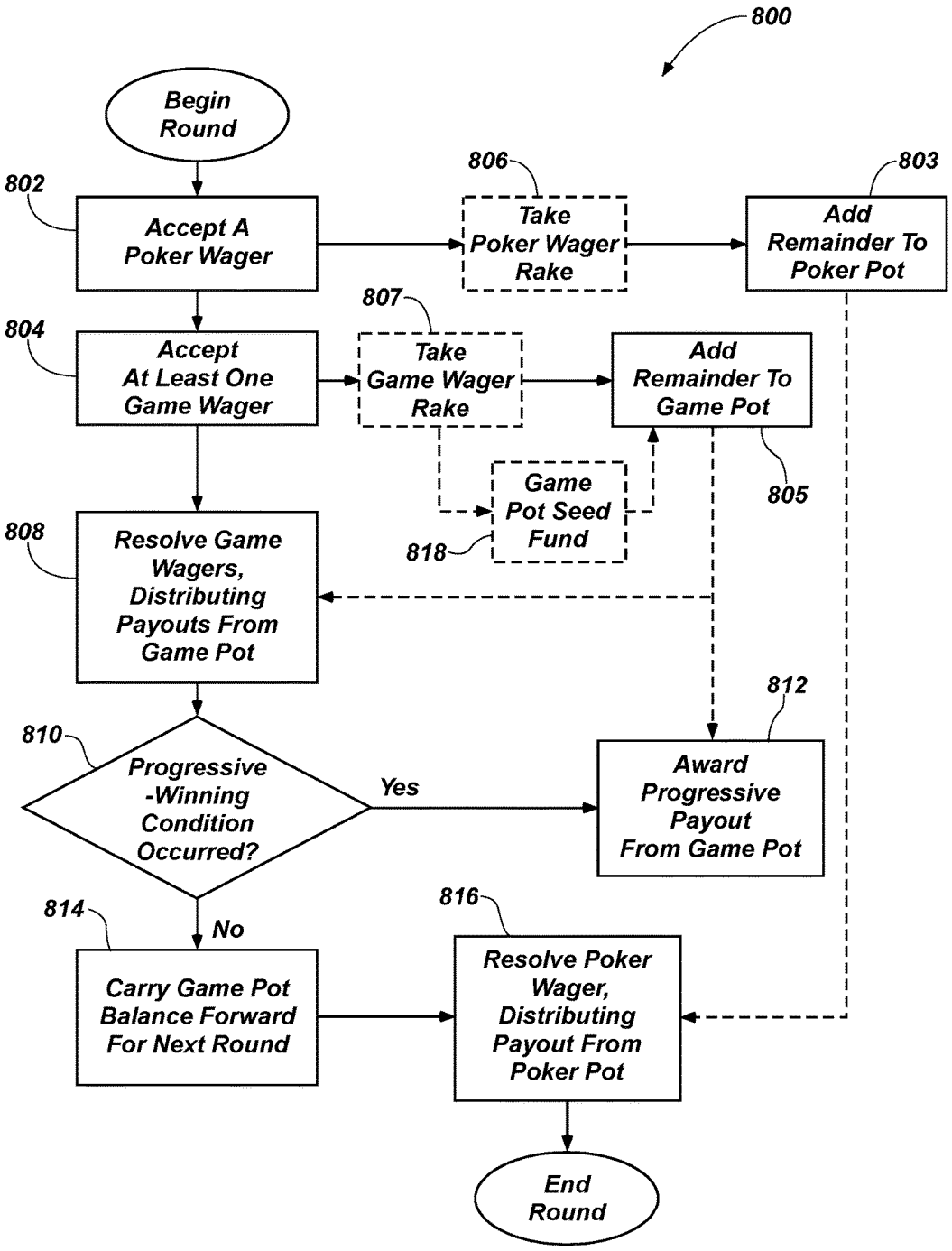
FIG. 11 is a flowchart diagram of a method of administering a wagering game, which may be at least partially player-pooled, according to a player-pooled progressive embodiment.

Referring to FIG. 11, shown is a flowchart diagram of a method 800 of administering a wagering game, which may be at least partially player-pooled, according to a player-pooled progressive embodiment. The method 800 includes accepting a first mandatory wager, referred to herein as a "poker wager," as indicated at 802. At least a portion of the poker wager is added to a poker pot, as indicated at operation 803. The poker wager may be later resolved by comparing player hands and awarding the poker pot, or at least a portion thereof, to the player holding a highest ranking poker hand in that round of play. For example, in a five card game, four of a kind would outrank three of a kind.

The poker pot may be a nonprogressive pot; more specifically, all or substantially all of the poker pot may be distributed at the conclusion of each round of the wagering game. In some embodiments, the poker wager may be a mandatory wager to qualify the player for play of the underlying wagering game. In other embodiments, the poker wager may be optional, and the wagering game may be administered to a player without receiving the poker wager and without qualifying the player for a potential payout from the poker pot.

At least one game wager may also be accepted, as indicated at 804. The game wagers may include, for example, base game wagers (e.g., ante wagers, blind wagers, play wagers, raises, and other wagers made on the underlying wagering game), side wagers, or both. More specifically, the game wagers may comprise, for example, the first and second wagers described previously in connection with FIG. 1A. At least a portion of each game wager is added to a game pot, as indicated at operation 805, which game pot may be a progressive pot.

In some embodiments, acceptance of the at least one game wager qualifies a player to be eligible to win an award in addition to the payouts available from the underlying game (i.e., the payouts on the first and second wagers described previously in connection with FIG. 1A), such as, for example, a progressive payout (e.g., a progressive jackpot awarded to one or more qualifying players). Therefore, in some such embodiments, a progressive wager may be received, in addition to the other game wagers received from the player, such as the first and second wagers described previously in connection with FIG. 1A. In other such embodiments, one of the game wagers may be converted to a progressive wager, such as, for example, the first and second wagers described previously in connection with FIG. 1A. In some embodiments, the progressive wager may be a mandatory wager to qualify the player for play of the underlying wagering game. In other embodiments, the progressive wager may be optional, and the wagering game may be administered to a player without receiving the progressive wager, in addition to any other game wagers, from the player and without qualifying the player to be eligible to win the progressive payout from the game pot.

In some embodiments, the poker wager and the at least one game wager may be received as indistinct wagers, with a portion thereof being designated for the poker pot (a nonprogressive pot) and another portion being designated for the game pot (a progressive pot).

In some embodiments, the game pot may be a pooled or linked pot. For example, the game pot may include one or more game wagers accepted from multiple concurrent wagering games. As another example, the game pot may include pooled progressive wagers from those wagering games currently being played and may include accumulated game wagers from past wagering games. As specific, nonlimiting examples, the game pot may include all game wagers accepted from a group of electronic gaming tables or other local wagering game administration devices at a casino, from multiple groups of remote devices connected to network gaming architecture, or both. In other embodiments, the game pot may not be pooled, and awards for the game wager may be limited to the amounts wagered at a respective electronic gaming table, other local wagering game administration devices, or a group of remote devices.

The game administrator may take a "rake" (e.g., a commission for the house) on at least one wager, such as the poker wager, as indicated at operation 806, the at least one game wager, as indicated at operation 807, or both. In some embodiments, therefore, a rake may be taken on all wagers, or any wager. For example, the house may collect a portion of the poker wager at the time the poker wager is placed. Additionally or alternatively, the house may collect a portion of the game wagers at the time the game wagers are placed.

The rake may be, for example, a fixed percentage of the wagers. More specifically, the percentage of the wagers collected for the rake may be, for example, greater than a theoretical house advantage for the underlying game. As another example, the rake may be less than an average house advantage for play of the wagering game by all players, including average and sub-average players, which may be calculated using a historical house advantage for the wagering game (e.g., a house advantage for the wagering game over the last 5, 10, or 15 years for a given casino or other gaming establishment). As specific, nonlimiting examples, the percentage of the wagers (i.e., either or both of the poker wager and the at least one game wager) collected for the rake may be between 3% and 8%, between 4% and 7%, or between 5% and 6%. In other embodiments, the portion of the wagers collected for the rake may be a variable percentage of the wagers or may be a fixed quantity (e.g., a flat fee) irrespective of the total amount for the wagers, a fixed percentage with a cap, or a time-based fee for increments of time playing the wagering game. Thus, in lieu of, or in addition to, a rake taken on one or more wagers, the house may be compensated in a number of other ways, including, without limitation, a flat fee per round of play, a percentage of wagers made with or without a cap, rental of a player "seat," or otherwise as is known in the gaming art. All such compensation may be generally referred to as a "commission."

All profits for the house may be made from the rake (or rakes or other commission) in some player-banked embodiments. In such embodiments, wagered amounts in excess of the rake are distributed either in the form of, for example, a progressive payout (as in a "player-pooled progressive" embodiment (FIG. 11)), a dividend refund (as in a "dividend refund" embodiment (FIG. 12)), or some combination thereof. Thus, the profits for the house may be limited. Such limiting of profits for the house and redistribution of wagers back to one or more players may increase the attractiveness of the wagering game to both inexperienced and highly skilled players. Because the amount earned by the house is known, highly skilled players may perceive that their skill will enable them to increase winnings, and inexperienced players may be enticed by the possibility of winning or otherwise earning a portion or all of one or more of the pots. In other embodiments, the house may make profits on the rake and on losses from one or more of the wagers (e.g., the first and second wagers described previously in connection with FIG. 1A), including losses resulting from optimal and suboptimal play.

The rake may be maintained in a rake account, and profits for the house may be deducted from the rake account. When and if taken from the poker wagers, the poker wager rake (operation 806) may be taken by, for example, electronically transferring funds from the poker wagers to a poker pot rake account (e.g., as instructed by a game service 616 (see FIG. 7) using casino account servers 632 (see FIG. 7)). Likewise, when and if taken from the game wagers, the game wager rake (operation 807) may be taken by, e.g., electronically transferring funds from the game pot wagers to a game pot rake account (e.g., as instructed by the game service 616 (see FIG. 7) using casino account servers 632 (see FIG. 7)).

In some embodiments, the poker wager may be accepted (operation 802) at the beginning of a round of administration of the wagering game. One or more of the game wagers may be accepted (operation 804) at the beginning of the round as well, e.g., the first and second wagers described previously in connection with FIG. 1A. In some embodiments, additional game wagers may be accepted (operation 804), possibly raked (operation 807), and added to the game pot (operation 805) in the intermediate segments of the round of play, e.g., any play wagers or raises permitted by game rules.

The underlying wagering game may be played as described above, including resolving the game wagers received during the round of play, as indicated at operation 808. For example, the underlying wagering game may be played at least substantially as described previously in connection with FIGS. 1A through 3. Payouts to be distributed, as a result of resolving the game wagers, (e.g., payouts on the first and second wagers described previously in connection with FIG. 1A), are paid from the game pot.

It is contemplated that only a portion of the game pot may be distributed, at operation 808, in the form of payouts on the underlying game. At least in embodiments in which the game pot is configured as a progressive pot (e.g., if one of the game wagers is a progressive wager or one game outcome of a low frequency pays the amount of the pot), all or substantially all of the remaining portion of the game pot may be designated for a potential progressive payout. For example, administering the player-pooled progressive embodiment of the player-pooled wagering game may include determining whether a progressive-winning condition has occurred, as indicated at operation 810. A progressive-winning condition may be predefined as a predetermined winning hand combination being dealt, which may result in an award of, for example, a portion of the game pot, or a premium winning hand composition being dealt, which may result in an award of, for example, an entire amount of the game pot. If such a progressive-winning condition has occurred during the round of game administration, a progressive payout may be awarded to the winning-hand-holding player, with the progressive payout being paid from the game pot, as indicated at operation 812. As just one example, a game may pay a progressive payout for achieving any of the sets of predetermined winning hands described previously in connection with FIG. 1A. If no progressive-winning condition has occurred, a progressive payout may not be paid from the game pot, but, rather, the game pot balance may be carried forward for the next round of play and so on, as indicated at operation 814, until a progressive-winning condition occurs during a subsequent round. Thus, the game pot may not be awarded at the end of each round of play, but may grow during each successive round in which no player is dealt a predetermined winning hand combination or a premium winning hand composition. However, if the underlying game payouts distributed at operation 808, or if a progressive payout is awarded at operation 812, without draining the game pot, the game pot may decrement until the game pot contributions, at operation 805, rebuild the game pot.

A predetermined winning hand combination may be, for example, a four of a kind, a full house, a flush, a straight, a three of a kind, two pair, or one pair. The hands qualifying as new winning hand combinations may be predetermined at the beginning of each round of play in some embodiments. In other embodiments, new winning hand combinations may be predetermined at the beginning of play and may remain fixed until it is determined that at least one player hand achieves a predetermined winning hand combination, at which time new winning hand combinations may be predetermined. In still other embodiments, the hand combinations qualifying as winning hand combinations may be predetermined at the outset of the wagering game and remain fixed for the duration of the wagering game. The hands qualifying as winning hand combinations may be predetermined at random from a list of possible winning hand combinations, from among a schedule with a fixed rotation of possible winning hand combinations, or using a fixed table of winning hand combinations.

A premium winning hand composition may be, for example, a four of a kind, a straight flush, or a royal flush. The hand compositions qualifying as premium winning hand compositions may remain fixed throughout the duration of the wagering game or may change during the wagering game. For example, after it has been determined that a player hand has achieved a premium winning hand composition, the hand compositions qualifying as premium winning hand compositions may be made more restrictive or less restrictive. As a specific, nonlimiting example, after identification of a player hand achieving a straight flush, the hand compositions qualifying as premium winning hand compositions may be restricted to royal flushes or may be expanded to include four of a kind. The hands qualifying as premium winning hand compositions may be predetermined at random from a list of possible premium winning hand compositions, following a schedule with a fixed rotation of possible premium winning hand compositions, or according to a fixed table of premium winning hand compositions.

In embodiments in which the game pot is a progressive pot, the amount awarded from the game pot for achieving a premium winning hand composition may be a progressive payout at least as great as a maximum progressive payout for achieving a predetermined winning hand composition. For example, the entire game pot may be awarded when a player or multiple players are dealt a premium winning hand composition, and only a portion of the game pot may be awarded when a player or multiple players are dealt a predetermined winning hand combination.

Awarding the game pot or a portion of the game pot may involve crediting a player account with funds from the game pot or may comprise distributing physical money or physical representations of money from the game pot to the player.

Before, between, or after resolving the game wagers (operation 808), determining whether a progressive-winning condition occurred (operation 810), awarding a progressive payout (operation 812), or any combination thereof, the poker wager may be resolved, and the poker pot may be awarded to at least one player, as indicated at operation 816. Each successive round of receiving wagers, dealing cards, and resolving wagers may constitute a round of play, and the poker pot may be awarded to at least one player before the end of each round of play. The player to whom the poker pot is awarded may hold a highest ranking hand of all hands dealt in a round on a table using conventional poker rankings, or a ranking system specific to the disclosed games when compared to the hands of other players at the virtual "table."

Awarding the poker pot or the portion of the poker pot may involve crediting a player account of each winning player or may comprise distributing physical money or physical representations of money to each winning player.

In some embodiments, an entire amount of the poker pot may be awarded to at least one player before the end of each round of play. In such embodiments, the poker pot may be a nonprogressive pot. Awarding the entire amount of a poker pot to at least one player at the end of each round of play redistributes lost poker wagers attributable to suboptimal play to other players, rather than to the house.

In some embodiments involving a no-house-advantage poker pot awarded at the end of each round and a progressive game pot that receives all other game wagers, all players participating in the wagering game from whom the at least one game wager has been received may be eligible to win the game pot or a portion of the game pot. Players who are ineligible to win the poker pot, and players from whom fold indications have been received but from whom one or more other active wagers in play have been received, may be eligible to win the game pot or a portion of the game pot.

In some embodiments, the game pot may be seeded with money from the game pot rake account or a reserve account (as indicated at operation 818) at the beginning of play, after the game pot or a portion of the game pot has been awarded, or both. In some embodiments, a minimum account balance sufficient to cover expected losses is retained when distributing a progressive payout (operation 812) such that no seed money is required in the game pot. For example, the game pot may be seeded from the rake account of the house (operation 818), and the house may maintain an amount of funds in the rake account sufficient to significantly reduce (e.g., to essentially eliminate) the likelihood that any payouts made from the rake account and any seeding amounts withdrawn from the rake account exhaust or overdraw the rake account. In some embodiments, a casino reserve account may be provided to fill the rake account in the event of an overdraw. Such seeding may incentivize players to participate in the wagering game, and specifically to place a game wager (e.g., a progressive wager) to be eligible for the progressive payout from the game pot. In addition, such seeding may reduce the likelihood that the amount of funds in the game pot may be insufficient to cover all the payouts to players. For example, where a player hand achieves a premium winning hand composition in one round of play, a player hand achieves a predetermined winning hand combination in the immediately following round of play, and a fixed-odds payout is to be awarded to the player holding the predetermined winning hand combination, the amount seeded to the game pot between those rounds of play may be at least as great as the maximum fixed-odds payout awardable for any predetermined winning hand combination. The game pot may be seeded each time the game pot is awarded in its entirety or each time the amount in the game pot is lower than the maximum fixed-odds payout.

Figure 12:
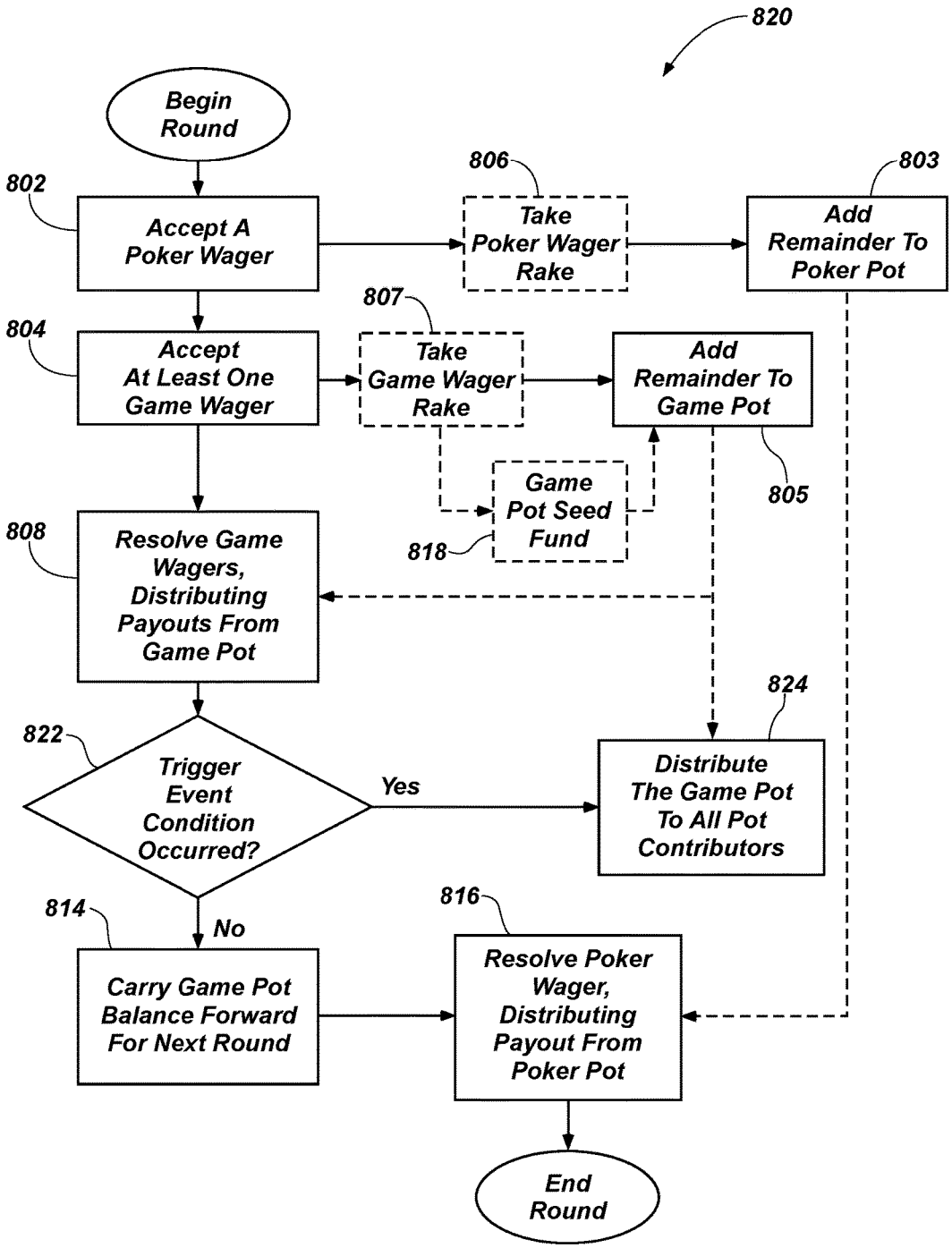
FIG. 12 is a flowchart diagram of a method of administering a wagering game, which may also be at least partially player-pooled, according to a dividend refund embodiment.

FIG. 12 is a flowchart diagram of a method 820 of administering a wagering game, which may be at least partially player-pooled, according to a dividend refund embodiment. The method 820 is largely the same as the method 800 of the player-pooled progressive (FIG. 11), with the exception that, rather than determining whether a progressive-winning condition has occurred (operation 810 (FIG. 11)), the method 820 includes determining whether a trigger event condition has occurred, as indicated at operation 822, and, if so, distributing the game pot to one or more past or present players of the wagering game, as indicated at operation 824 (rather than distributing the game pot as a progressive payout as at operation 812 (FIG. 11)). In such embodiment, the game pot may accumulate between rounds of play, and, to periodically reduce the balance, a dividend (e.g., a share of the game pot awarded to each participating player) may be awarded to players from the game pot. Thus, what would otherwise be the profits from lost wagers, less amounts raked by the house, are redistributed back to the players, rather than collected by the house as revenue. Thus, the distribution is not a payout on the underlying game, but a refund.

The game pot may be distributed among a plurality of players upon the occurrence of a predetermined event (referred to herein as a "trigger event"), as indicated at operation 822. The predetermined, trigger event may not be based, for example, on player skill or chance events occurring in the underlying wagering game. The predetermined trigger event may comprise, for example, determination that at least one player participated for a predetermined number of hands; completed a predetermined number of rounds of play at a given table, electronic gaming machine, or remote gaming device; reached a predetermined time limit since play commenced; or reached a predetermined amount within the game pot. The predetermined trigger event or condition may be time-based, pot-based (or pool-based), game-based, amount-based, or other-based. Further details on pot distributions based on predetermined trigger events and conditions are disclosed in the U.S. patent application Ser. No. 13/871,824, filed Apr. 26, 2013, titled "DISTRIBUTING SUPPLEMENTAL POT IN WAGERING GAMES BASED ON PREDETERMINED EVENT," the disclosure of which is incorporated herein in its entirety by this reference.

The dividend distributions may be divided at least among players currently participating in the wagering game. In some embodiments, the dividend distributions may also be paid to players who previously contributed to the game pot but who have since ceased participating in the wagering game. In some embodiments, the dividend distributions may not be paid to players from whom contributions to the game pot have not been received since the last dividend distribution was paid. The percentage of the game pot refunded to each player as a dividend distribution may be, for example, approximately equal to the percentage of hands won by each player, the percentage of first pot winnings won by each player based on game play, the percentage of total wager amounts received from each player, the proportional number of wagers received from each player, the proportional length of time spent playing the wagering game by each player, or an equal percentage for each player eligible to receive a dividend distribution from the game pot.

The dividend refund may be distributed in the form of a credit made to the receiving players' accounts. In some embodiments, the refund may be paid without concurrently alerting the player, though the refund may be noticeable when and if the player next checks his or her balance in his or her player account.

In some embodiments, wagering games may be administered without players risking money in connection with the wagers (i.e., "play-for-fun" games). Access to play-for-fun wagering games may be granted on a time period basis in some embodiments. For example, upon initially joining the wagering game, each player may automatically be given nonmonetary wagering elements, such as, for example, chips, points, or simulated currency, that are of no redeemable value. After joining, the player may be permitted to place bets using the wagering elements and a timer may track how long the player has been participating in the wagering game. If the player exhausts his or her supply of the wagering elements before a predetermined period of time has expired, the player may be permitted to simply wait until the period of time passes to rejoin the game, at which time access to another quantity of the wagering elements may be granted to the player to permit the player to resume participation in the wagering game.

In some embodiments, a hierarchy of players may determine the quantity of wagering elements given to a player for each predetermined period of time. For example, players who have been participating in the wagering game for a longer time, who have played closest to optimal strategy for the game, who have won the largest percentage of wagers, who have wagered the most in a play-for-pay environment, or who have won the largest quantities of wagering elements from their wagers may be given more wagering elements for each allotment of time than players who have newly joined, who have played according to poor strategy, who have lost more frequently, or who have lost larger quantities of wagering elements. In some embodiments, the hierarchy of players may determine the duration of each allotment of time. For example, players who have been participating in the wagering game for a longer time, who have played closest to optimal strategy for the game, who have won the largest percentage of wagers, or who have won the largest quantities of wagering elements from their wagers may be given shorter allotments of times to wait for an award of more wagering elements than players who have newly joined, who have played according to poor strategy, who have lost more frequently, or who have lost larger quantities of wagering elements. In some embodiments, players who have not run out of wagering elements after the period of time has expired may have the balance of their wagering elements reset for a subsequent allotment of time. In other embodiments, players who have not run out of wagering elements may be allowed to retain their remaining wagering elements for subsequent allotments of time, and may be given additional wagering elements corresponding to the new allotment of time to further increase the balance of wagering elements at their disposal. Players may be assigned to different categories of players, which determine the number of wagering elements awarded. In a given period of time, higher level players, or players who have invested more time playing the game may be allotted more wagering elements per unit of time than a player assigned to a lower level group.

Therefore, in some embodiments, the wagering game may be administered by receiving wagers (e.g., the first and second wagers described previously in connection with FIG. 1A) of no real-world monetary value, and payouts (e.g., the payouts on the first and second wagers described previously in connection with FIG. 1A) may be paid without transferring real-world monetary value to the players. Such embodiments, referred to herein as "free play-for-fun" embodiments are nonetheless contemplated as modes of carrying out the methods described herein.

In some embodiments, referred to herein as "social play-for-fun" embodiments, a player may be permitted to redeem an access token of no redeemable face value, such as, for example, points associated with a player account (e.g., social media account credits, online points associated with a transacting account, etc.), to compress the period of time and receive more wagering elements. The access tokens may be sold or may be given without directly exchanging money for the access tokens. For example, access tokens may be allocated to players who participate in member events (e.g., complete surveys, receive training on how to play the wagering game, share information about the wagering game with others), spend time participating in the wagering game or in a player account forum (e.g., logged in to a social media account), or view advertising. Thus, an entity administering social play-for-fun wagering games may not receive money from losing player wagers or may not take a rake on wagers, but may receive compensation through advertising revenue or through the purchase of access tokens redeemable for time compressions to continue play of the wagering game or simply to increase the quantity of wagering elements available to a player.

After receipt of an indication that a player has stopped participating in a play-for-fun wagering game (e.g., a free play-for-fun embodiment, a social play-for-fun embodiment), any remaining quantities of the wagering elements may be relinquished by the player and retained by the administrator, in some embodiments. For example, receipt of an indication that the player has logged out of a play-for-fun wagering game administered over the Internet may cause any remaining wagering elements associated with a respective player to be lost. Thus, when the player rejoins the play-for-fun wagering game, the quantity of wagering elements given to the player for an allotment of time may not bear any relationship to the quantity of wagering elements held by the player when he or she quit playing a previous session of the wagering game. In other embodiments, upon receipt of an indication that a player has stopped playing, the quantity of wagering elements held by the player at that time may be retained and made available to the player, along with any additional quantities of wagering elements granted for new allotments of time, upon receipt of an indication that the player has rejoined the wagering game.

Figure 13:
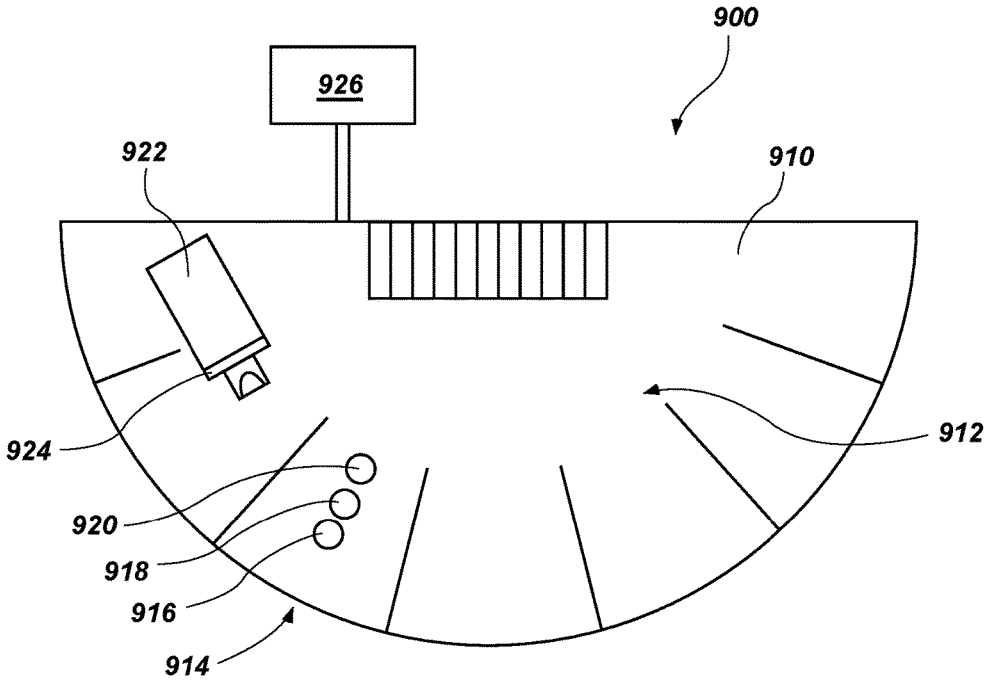
FIG. 13 is a schematic view of an illustrative embodiment of a specific system for administering a wagering game in accordance with this disclosure.

FIG. 13 is a schematic view of an illustrative embodiment of a specific system 900 for administering a wagering game in accordance with this disclosure. The system 900 may include, for example, a gaming table 910 including a playing surface 912 on which player positions 914 including wagering areas 916, 918, and 920 may be displayed. An automatic card-handling device 922 may be supported by the gaming table 910, such as, for example, on the playing surface 912 or extending at least partially up through the playing surface 912. The automatic card-handling device 922 may include, for example, an integrated electronic display device 924 in some embodiments. The system 900 may include an upright electronic display device 926 separate from the automatic card-handling device 922 in some embodiments.

Such equipment may be used to administer a wagering game in accordance with this disclosure. For example, the first wager may be accepted by receiving one or more wagering elements in the first wagering area 916, the second wager may be accepted by receiving one or more wagering elements in the second wagering area 918, and any play wager may be accepted by receiving one or more wagering elements in the third wagering area 920. Cards may be dealt by a dealer retrieving subsets of cards from the automatic card-handling device 922 and distributing them to participating players, the dealer, and any community card area. The number of eligible hands may be automatically determined by the automatic card-handling device 922 tracking the number of subsets of cards dispensed and subtracting any subset corresponding to community cards and optionally the subset corresponding to the dealer hand. The correct pay table from a set of pay tables corresponding to the specific number of eligible hands may be displayed on the electronic display device 924 of the automatic card-handling device 922, the dedicated electronic display device 926, or both. The wagers may also be automatically resolved by the automatic card-handling device 922, which may read and track the ranks and suits of cards in the eligible hands and compare the hands achieved to the appropriate pay table.

Figure 14:
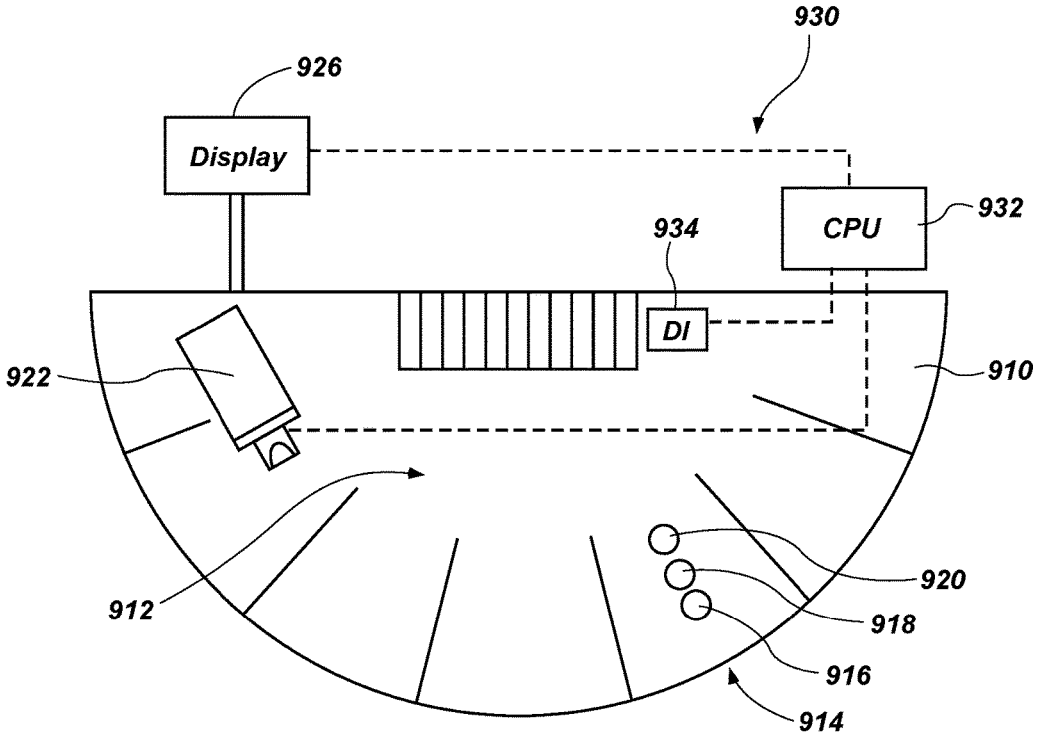
FIG. 14 is a schematic view of another illustrative embodiment of another specific system for administering a wagering game in accordance with this disclosure.

FIG. 14 is a schematic view of another illustrative embodiment of another specific system 930 for administering a wagering game in accordance with this disclosure. The system 930 may include, for example, a gaming table 910 including a playing surface 912 on which player positions 914 including wagering areas 916, 918, and 920 may be displayed. An automatic card-handling device 922 may be supported by the gaming table 910, such as, for example, on the playing surface 912 or extending at least partially up through the playing surface 912. The automatic card-handling device 922 may be operatively connected to a game-administering processing unit 932. The processing unit 932 may further be operatively connected to a dealer input device 934 and an upright electronic display device 926 separate from the automatic card-handling device 922 in some embodiments.

Such equipment may be used to administer a wagering game in accordance with this disclosure. For example, the first wager may be accepted by receiving one or more wagering elements in the first wagering area 916, the second wager may be accepted by receiving one or more wagering elements in the second wagering area 918, and any play wager may be accepted by receiving one or more wagering elements in the third wagering area 920. Cards may be dealt by a dealer retrieving subsets of cards from the automatic card-handling device 922 and distributing them to participating players, the dealer, and any community card area. The number of eligible hands may be automatically determined by the automatic card-handling device 922 tracking the number of subsets of cards dispensed and the processing unit 932 subtracting any subset corresponding to community cards and optionally the subset corresponding to the dealer hand. The correct pay table from a set of pay tables corresponding to the specific number of eligible hands may be displayed on the dedicated electronic display device 926. The wagers may also be automatically resolved by the automatic card-handling device 922, which may read and track the ranks and suits of cards in the eligible hands, and the processing unit 932, which may compare the hands achieved to the appropriate pay table.

Figure 15:
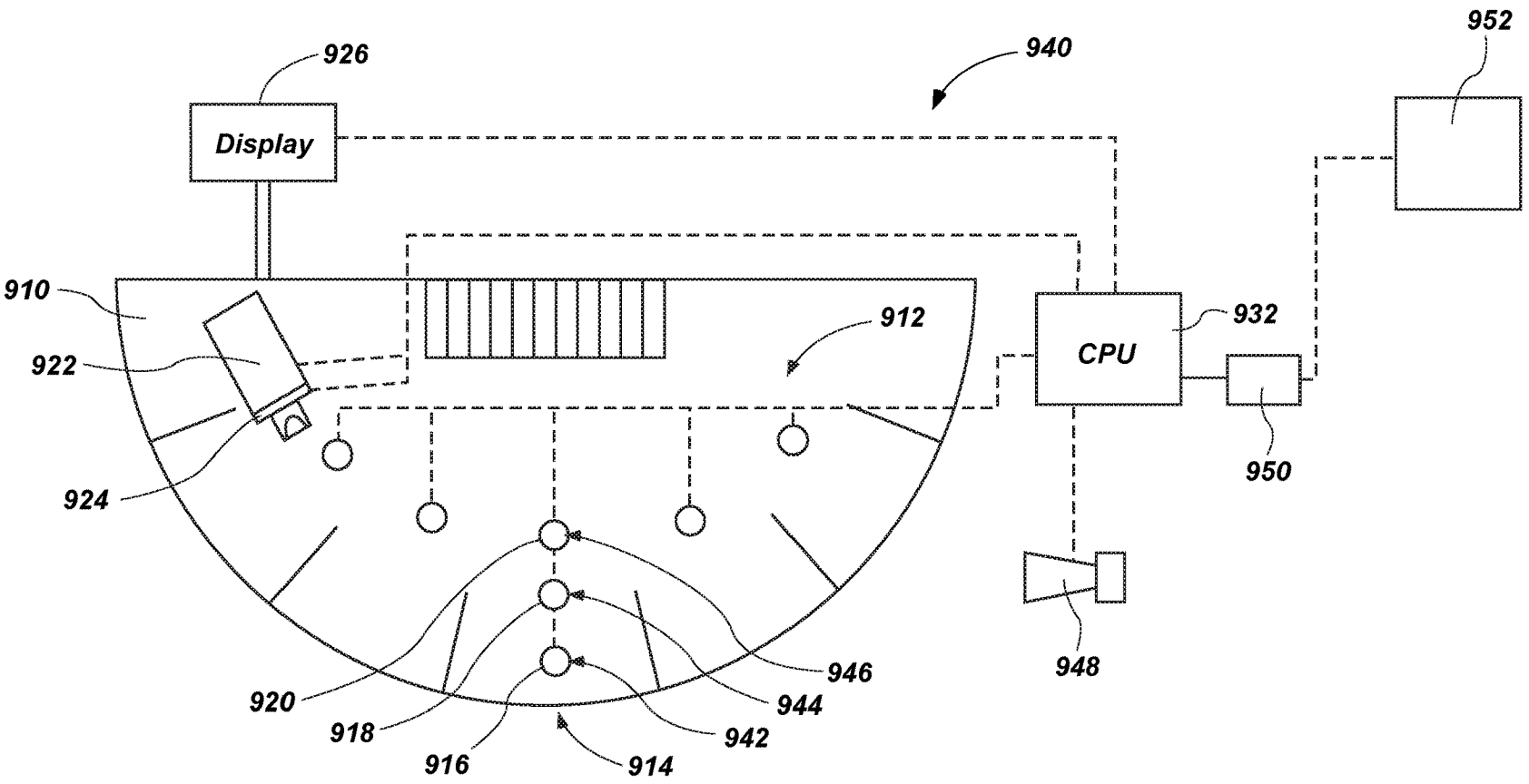
FIG. 15 is a schematic view of yet another illustrative embodiment of yet another specific system for administering a wagering game in accordance with this disclosure.

FIG. 15 is a schematic view of yet another illustrative embodiment of yet another specific system 940 for administering a wagering game in accordance with this disclosure. The system 940 may include, for example, a gaming table 910 including a playing surface 912 on which player positions 914 including wagering areas 916, 918, and 920 may be displayed. The wagering areas 916, 918, and 920 may include wagering-element sensors 942, 944, and 946 configured to detect the presence or absence of a wagering element in the associated wagering area 916, 918, and 920 to enable automatic wager registration and acceptance. An automatic card-handling device 922 may be supported by the gaming table 910, such as, for example, on the playing surface 912 or extending at least partially up through the playing surface 912. The automatic card-handling device 922 may include, for example, an integrated electronic display device 924 in some embodiments. The automatic card-handling device 922 and wagering-element sensors 942, 944, and 946 may be operatively connected to a game-administering processing unit 932. The processing unit 932 may further be operatively connected to a speaker 948 within hearing range of the playing surface 912, a communication device 950 in operative connection with a central game tracking unit 952 (e.g., a server) configured to record and store historical game data, and an upright electronic display device 926 separate from the automatic card-handling device 922 in some embodiments.

Such equipment may be used to administer a wagering game in accordance with this disclosure. For example, the first wager may be accepted by receiving one or more wagering elements in the first wagering area 916, the second wager may be accepted by receiving one or more wagering elements in the second wagering area 918, and any play wager may be accepted by receiving one or more wagering elements in the third wagering area 920 and automatically detecting the presence of such wagering elements utilizing the wagering-element sensors 942, 944, and 946. Cards may be dealt by a dealer retrieving subsets of cards from the automatic card-handling device 922 and distributing them to participating players, the dealer, and any community card area. The number of eligible hands may be automatically determined by the automatic card-handling device 922 tracking the number of subsets of cards dispensed and the processing unit 932 subtracting any subset corresponding to community cards and optionally the subset corresponding to the dealer hand. The correct pay table from a set of pay tables corresponding to the specific number of eligible hands may be displayed on the electronic display device 924 of the automatic card-handling device 922, the dedicated electronic display device 926, or both. The wagers may also be automatically resolved by the automatic card-handling device 922, which may read and track the ranks and suits of cards in the eligible hands, and the processing unit 932, which may compare the hands achieved to the appropriate pay table.

While certain illustrative embodiments have been described in connection with the figures, those of ordinary skill in the art will recognize and appreciate that the scope of this disclosure is not limited to those embodiments explicitly shown and described in this disclosure. Rather, many additions, deletions, and modifications to the embodiments described in this disclosure may be made to produce embodiments within the scope of this disclosure, such as those specifically claimed, including legal equivalents. In addition, features from one disclosed embodiment may be combined with features of another disclosed embodiment while still being within the scope of this disclosure, as contemplated by the inventors.

What is claimed is:

1. A gaming table system configured to at least partially automatically administer a wagering game, the gaming table system comprising:

a gaming table comprising a playing surface having a layout displayed thereon, the layout comprising a plurality of player positions thereon, each player position comprising a first wagering area for accepting a first wager on a base game and a second wagering area for accepting a second wager on a secondary game;

an automatic card-handling device supported by the gaming table, the automatic card-handling device configured to output subsets of cards from a set of randomized, physical cards comprising at least one deck of at least fifty-two standard playing cards;

one or more sensors configured to detect one or more indicators of a number of eligible hands in the base wagering game;

an electronic display device positioned and oriented to be visible by at least one of a player participating in the wagering game and a dealer aiding in administration of the wagering game; and at least one processor operatively connected to at least the electronic display device and a nontransitory memory device, the at least one processor being programmed to:

receive one or more data signals indicating the number of eligible hands in the base game from the one or more sensors;

dynamically select a pay table corresponding to the number of eligible hands in the base wagering game from a set of pay tables stored in the nontransitory memory device, each pay table of the set of pay tables being different from each other pay table of the set of pay tables, each pay table of the set of pay tables corresponding to a single, specific number of eligible hands in a round of play of the base wagering game;

cause the electronic display device to display the dynamically selected pay table;

resolve the first wager by evaluating all hands available to each participating player to determine whether they satisfy a base game winning condition;

resolve the second wager by evaluating all hands available to each player participating in the base game to determine whether a best hand formable from any hand available to any participating player is a predetermined winning hand; and generate an electronic signal indicating that payment of a payout on the second wager to each participating player from whom the second wager was accepted from the pay table is authorized when any best hand available to any participating player is a predetermined winning hand, an amount of the payout shown on the pay table corresponding to a highest-ranked predetermined winning hand available to any participating player.

2. The system of claim 1, wherein the automatic card-handling device is configured to detect and record a number of dispensed subsets of cards using the one or more sensors.

3. The system of claim 1, wherein the at least one processor is programmed with an algorithm to determine the number of eligible hands based in part on a count of the number of dispensed subsets of cards from the automatic card-handling device detected by the one or more sensors.

4. The system of claim 3, wherein the at least one processor is programmed to subtract one from the number of dispensed subsets of cards to determine the number of eligible hands.

5. The system of claim 3, wherein the at least one processor is programmed to subtract two from the number of dispensed subsets of cards to determine the number of eligible hands.

6. The system of claim 1, wherein the at least one processor is further programmed to evaluate a dealer hand to determine whether the dealer hand is a predetermined winning hand and to generate the electronic signal indicating that payment of a payout on the second wager to each participating player from whom the second wager was accepted from the pay table is authorized when the dealer hand is a predetermined winning hand.

7. The system of claim 1, wherein the electronic display device is integrated into the automatic card-handling device.

8. The system of claim 1, wherein the electronic display device is located in a plane vertically above the playing surface and is oriented to face the plurality of player positions.

9. The system of claim 1, wherein the at least one processor is further programmed to cause the electronic display device to display an indication whether a second-wager winning event has occurred during a given round of play.

10. The system of claim 1, wherein the one or more sensors further comprises a first wagering-element sensor located in each player position, the first wagering-element sensor being configured to detect the presence of a wagering element in the first wagering area to accept the first wager, and a second wagering-element sensor located in each player position, the second wagering-element sensor being configured to detect the presence of a wagering element in the second wagering area to accept the second wager, the first and second wagering-element sensors being operatively connected to the at least one processor.

11. A system to support a round of play of a base card game with a supplemental game feature comprising:

a table layout display including (1) a plurality of player positions each having a first location to register a first wager to play a hand of the base game and a second location to register a side wager for the supplemental game feature and (2) a dealer position;

a processor;

a video display;

one or more sensors configured to detect one or more indicators of a number of hands playing the base game and (2) generate a data signal representing the number of hands playing the base game, the data signal received by the processor;

the processor configured to (1) determine from the data signal and from a plurality of different side wager pay tables, which are based upon the number of hands playing the base game, the pay table to apply to the side wager for the round of play and (2)control the video display to display the determined pay table;

wherein playing cards are distributed to each player position having made the first wager to define one or more player hands and optionally the dealer position to define a dealer hand according to the rules of the base game and at the conclusion of the play of the base game, and to determine the outcome of the side wager, comparing the holdings of all player hands and if any compared hand includes a side wager winning outcome, issuing an award for each side wager based upon the displayed pay table.

12. The system of claim 11, further comprising a memory storing data representing each of the different pay tables, the processor configured to select the pay table to apply to the round from data structure based upon the data signal and to control the video display to display the selected pay table.

13. The system of claim 11, further comprising a dealer input interface whereby the dealer enters the number of hands playing the base game.

14. The system of claim 11, further comprising a card shuffling and distribution apparatus including the one or more sensors, the card shuffling and distribution apparatus automatically determining the number of hands playing the base game.

15. The system of claim 11, wherein the table layout display is a physical game table layout to accommodate physical players, wherein the one or more sensors are configured to sense the number of hands playing the base game.

16. In a card game of the type where playing cards are distributed to a plurality of players and a dealer to form a plurality of player hands and a dealer hand for a round of play of a base card game, apparatus to dynamically determine and display a pay table for a side wager feature comprising:

one or more sensors configured to determine the number of player hands for the base game in a round of play and to generate a data signal corresponding to the number;

a processor in communication with the one or more sensors; and one or more video displays:

wherein the processor is configured to (1) dynamically determine for the round of play from a plurality of different side wager pay tables each based upon the number of hands for the base game of the round and from the data signal, the side wager pay table to apply to the round of play and (2) control the one or more video displays to display the determined pay table for the players; and wherein at the conclusion of the play of the base game and to determine the outcome of the side wager, the holdings of all player hands and if any eligible hand includes a side wager winning outcome, issuing an award for each side wager based upon the displayed pay table.

17. A method of administering a wagering game, comprising:

receiving, by a gaming table, a first physical, monetarily valuable wagering element in a first designated area of a player position of each of one or more participating players on a layout design on a playing surface of gaming table to accept a first wager on a base game from the one or more participating players;

receiving, by the gaming table, a second physical, monetarily valuable wagering element in a second designated area of the player position of the at least one of the one or more participating players on the layout design on the playing surface of the gaming table to accept an optional second wager on a secondary game from the at least one or more participating players;

dispensing, by an automatic card-handling device supported by the gaming table, cards to be dealt to the one or more participating players and to a dealer from a set of randomized, physical cards comprising at least one deck of at least fifty-two standard playing cards;

detecting, by one or more sensors, one or more indicators of a number of participating players in the base game;

transmitting, by the one or more sensors, a data signal representing the number of participating players to at least one processor;

displaying, by an electronic display device, a pay table corresponding at least partially to a number of participating players in the base wagering game, the pay table being dynamically selected from a set of pay tables by the at least one processor based on the data signal, each pay table of the set of pay tables being different from each other pay table of the set of pay tables, each pay table of the set of pay tables corresponding at least partially to a single, specific number of participating players in a round of play of the base wagering game;

resolving, by the at least processor, the first wager by evaluating all eligible hands available to each of the one or more participating players to determine whether each hand satisfies a base game winning condition;

resolving, by the at least processor, the second wager by evaluating all hands available to each of the one or more participating players to determine whether a best hand formable from all hands available to any of the one or more participating players is a predetermined winning hand; and paying a payout on the second wager from the pay table to each participating player in the secondary wagering game when any best hand formable from all hands available to any participating player is a predetermined winning hand by transferring at least one physical monetarily valuable wagering element to the at least one of the one or more participating players, an amount of the payout shown on the pay table.

18. The method of claim 17, wherein a number of eligible hands in the secondary game is determined by an automatic card shuffler.

19. The method of claim 17, wherein the base game is ULTIMATE TEXAS HOLD 'EM®, dealing the cards from the automatic card-handling device to the one or more participating players and to the dealer comprises dealing two cards from the automatic card-handling device to each of the one or more participating players and to the dealer, and resolving the first wager comprises comparing a rank of a best five-card poker hand formable from the cards available to each of the one or more participating players' respective hands to another pay table to determine whether it is one of a set of predetermined winning ranks and further comprising:

dealing five community cards available to each of the one or more participating players and to the dealer from the set of randomized, physical cards from the automatic card-handling device to form the best five-card poker hand;

paying a payout on the first wager when the rank of the best five-card poker hand formable from the cards available to a respective one of the one or more participating players is a predetermined winning rank by transferring at least one physical, monetarily valuable wagering element to the respective one participating player; and collecting the first wager when the rank of the best five-card poker hand formable from the cards available to the respective one of the one or more participating player is not a predetermined winning rank by retrieving each physical, monetarily valuable wagering element from the first designated area of the player position of the respective one participating player.

20. The method of claim 17, wherein the one or more sensors are operatively connected to the electronic display device, the one or more sensors being selected from a group consisting of a sensor positioned to detect players' physical bodies, a sensor positioned to detect players' body heat, and a plurality of sensors positioned to detect the number of first designated areas occupied by corresponding physical, monetarily valuable wagering elements.

21. The method of claim 17, further comprising automatically detecting the number of participating players utilizing the automatic card-handling device including the one or more sensors by recording a number of hands dealt when initially dealing cards to each participating player and the dealer.

22. The method of claim 17, further comprising the dealer inputting the number of players utilizing a dealer input device operatively connected to the electronic display device.

23. The method of claim 17, wherein displaying the pay table corresponding to the number of participating players in the wagering game on the electronic display device comprises displaying the pay table corresponding to the number of participating players in the wagering game on one or more electronic display devices located on the automatic card-handling device, embedded in the playing surface of the gaming table, or on a side of the gaming table opposite a side on which the one or more participating players are located.

24. The method of claim 17, wherein resolving the second wager by evaluating all the cards available to each player to determine whether the best hand formable from all the cards available to any of the one or more participating players is a predetermined winning hand comprises determining a best five-card poker hand formable according to five-card poker rankings and determining whether the best five-card poker hand formable from all the cards available to any of the one or more participating players is ranked a full house or higher.

25. The method of claim 17, further comprising:

adding or removing at least one participating player after completing a first round of the wagering game; and displaying a different pay table from the set of pay tables corresponding to the changed number of participating players in the wagering game on the electronic display device during a second, subsequent round of the wagering game.

26. The method of claim 25, wherein displaying the different pay table during the second, subsequent round of the wagering game comprises displaying a pay table during the second round having a lower payout for at least one of the predetermined winning hands when the number of participating players increases or displaying a pay table during the second round having a higher payout for at least one of the predetermined winning hands when the number of participating players decreases.

27. The method of claim 17, wherein displaying the pay table from the set of pay tables comprises displaying a pay table selected from the set of pay tables consisting of:

| Predetermined | Number of Participating Players | | | | | |
|---|---|---|---|---|---|---|
| Winning Hand | 6 | 5 | 4 | 3 | 2 | 1 |
| Royal Flush | 70:1 | 80:1 | 100:1 | 125:1 | 150:1 | 200:1 |
| Straight Flush | 30:1 | 40:1 | 40:1 | 70:1 | 80:1 | 100:1 |
| Four of a Kind | 20:1 | 30:1 | 35:1 | 40:1 | 50:1 | 70:1 |
| Full House | 4:1 | 4:1 | 5:1 | 6:1 | 8:1 | 12:1. |

28. The method of claim 17, wherein paying the payout on the second wager when any best hand formable from all cards available to any of the one or more participating players is a predetermined winning hand comprises paying the payout to each participating player from whom the second wager was accepted on the second wager when any best hand formable from all cards available to any of the one or more participating players is a predetermined winning hand.

29. A method of administering a wagering game, comprising:

receiving, by a gaming table, a first physical, monetarily valuable wagering element in a first designated area of a player position of each participating player on a layout design on a playing surface of the gaming table to accept a base game wager on a game of ULTIMATE TEXAS HOLD 'EM® from one or more participating players;

receiving, by the gaming table a second physical, monetarily valuable wagering element in a second designated area of a player position of at least one of the one or more participating players on the layout design on the playing surface of the gaming table to accept a mandatory side wager from each of the one or more participating players;

dispensing, by an automatic card-handling device supported by the gaming table, cards to be dealt wherein two cards are dealt to each of the one or more participating players and a dealer from a set of randomized, physical cards comprising at least one deck of at least fifty-two standard playing cards;

dealing five community cards available to each of the one or more participating players and the dealer from the set of randomized, physical cards from the automatic card-handling device;

detecting, by one or more sensors, one or more indicators of a number of participating players in the game of ULTIMATE TEXAS HOLD 'EM®;

transmitting, by the one or more sensors, a data signal indicating the number of participating players to at least one processor;

displaying, by an electronic display device, a pay table corresponding to a number of participating players in the game of ULTIMATE TEXAS HOLD 'EM®, the pay table being selected from a set of pay tables by the at least one processors based on the data signal, each pay table of the set of pay tables being different from each other pay table of the set of pay tables, each pay table of the set of pay tables corresponding to a single, specific number of participating players in a round of play of the game of ULTIMATE TEXAS HOLD 'EM®;

resolving, by the at least processor, the base game wager by evaluating all cards available to each of the one or more participating players and to the dealer to determine whether a best five-card poker hand formable from all the cards available to each respective participating player outranks a best five-card poker hand formable from all the cards available to the dealer;

resolving, by the at least processor, the side wager by evaluating all cards available to each of the one or more participating players and the dealer to determine whether a best five-card poker hand formable from all cards available to any of the one or more participating players or the dealer is a predetermined winning hand; and paying a payout on the side wager to each of the one or more participating players from the pay table when any best five-card poker hand formable from all cards available to any of the one or more participating players or the dealer is a predetermined winning hand by transferring at least one physical monetarily valuable wagering element to each of the one or more participating players, an amount of the payout shown on the pay table corresponding to a highest-ranked predetermined winning hand formable from all cards available to any of the one or more participating players or the dealer.

* * * * *